US008028986B2

(12) United States Patent
Koga et al.

(10) Patent No.: US 8,028,986 B2
(45) Date of Patent: Oct. 4, 2011

(54) GEARS FOR MANUFACTURING PRINTER, METHOD OF USING THE GEARS, AND THE PRINTER

(75) Inventors: Yuji Koga, Nagoya (JP); Daisuke Kozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 819 days.

(21) Appl. No.: 11/615,663

(22) Filed: Dec. 22, 2006

(65) Prior Publication Data

US 2008/0012206 A1 Jan. 17, 2008

(30) Foreign Application Priority Data

Dec. 29, 2005 (JP) ..... 2005-380644

(51) Int. Cl.
*B65H 5/00* (2006.01)

(52) U.S. Cl. ..... 271/10.01; 271/114

(58) Field of Classification Search ..... 271/10.01, 271/10.09, 10.1, 114, 9.01; 74/341, 342, 74/354, 473.36, 473.37, 384, 421 R, 421 A
See application file for complete search history.

(56) References Cited

U.S. PATENT DOCUMENTS

| | | | | |
|---|---|---|---|---|
| 794,464 | A * | 7/1905 | Parker | 74/333 |
| 855,068 | A * | 5/1907 | Parker | 74/333 |
| 5,841,450 | A | 11/1998 | Kawamura | |
| 6,105,450 | A * | 8/2000 | Sasaki et al. | 74/421 A |
| 2004/0124575 | A1 * | 7/2004 | Lee et al. | 271/10.01 |
| 2005/0195246 | A1 | 9/2005 | Ogawa | |
| 2006/0071389 | A1 | 4/2006 | Kozaki et al. | |

* cited by examiner

*Primary Examiner* — Stefanos Karmis
*Assistant Examiner* — Thomas Morrison
(74) *Attorney, Agent, or Firm* — Baker Botts L.L.P.

(57) ABSTRACT

A printer having a switch gear, first driven gear and second driven gear. The switch gear has a spur gear and is slidable along a direction that is parallel to a rotation axis of the spur gear. The first driven gear has a first spur gear and a cylinder fixed to the first spur gear. The cylinder is concentric with respect to the first spur gear and extends along the above direction. A hole is formed on the second driven gear. The hole is concentric with respect to a second spur gear and extends along the above direction. The second driven gear is rotatably mounted on the first driven gear by inserting the cylinder of the first driven gear into the hole of the second driven gear. The switch gear slides between a first position for engagement with the first driven gear and a second position for engagement with the second driven gear along the above direction. Since the driven gears are formed in this way, the position of the first driven gear in the above direction is not changed even when the second driven gear is not provided.

10 Claims, 26 Drawing Sheets

GEARS FOR MANUFACTURING PRINTER, METHOD OF USING THE GEARS, AND THE PRINTER

CROSS-REFERENCE TO RELATED APPLICATION

This application claims priority to Japanese Patent Application No. 2005-380644 filed on Dec. 29, 2005, the contents of which are hereby incorporated by reference into the present application.

BACKGROUND OF THE INVENTION

1. Field of the Invention

The present invention relates to gears used for manufacturing, a printer, a method of using the gears, and the printer manufactured by using the gears.

2. Description of the Related Art

Printers which are capable of printing an image on a sheet on the basis of an input signal are generally known. These printers have a print head, a feeding tray for storing a plurality of sheets, a feeding roller, a conveying roller, a catch tray, and the like. The feeding tray can store a plurality of sheet of various sizes (for example, A4 size, B5 size, legal size, postcard size, and the like). When printing an image on a sheet, the feeding roller contacts with the sheets on the feeding tray 1 and then rotates. Accordingly, one sheet is taken out from the feeding tray. The sheet sent out by the feeding roller is conveyed by the conveying roller. An image is printed on the sheet by the print head while the sheet is conveyed. The sheet printed with the image is discharged to the catch tray by the conveying roller.

The printer comprises a plurality of mechanisms. For example, one mechanism rotates the feeding roller, and other mechanism rotates the conveying roller.

There are many printers that use a single motor to drive a plurality of mechanisms. This type of printer comprises a driving force transmitting device for transmitting driving force to the plurality of the motor. The driving force transmitting device is positioned between the mechanisms and the motor. A driving device is constituted by combining a plurality of gears.

There are cases in which the plurality of mechanisms, which are driven by a single motor, need to be driven independently. For example, sometimes switching needs to be performed between a state in which the conveying roller is rotated without rotating the feeding roller, and a state in which the feeding roller is rotated without rotating the conveying roller.

In order to respond to the above requirements, the driving force transmitting device sometimes comprises a switch gear and a set of driven gears. The switch gear is driven by the motor. Each of the driven gears is engaged with a corresponding mechanism. The switch gear can slide in a direction parallel to the axis of rotation of the switch gear (in other words, the switch gear can move in parallel). The set of driven gears is situated so it has a positional relationship where all of the gears can be engaged with the switch gear.

As the switch gear slides and then stops, it selects a driven gear allows it to be engaged. As the motor rotates in such a state, one selected driven gear rotates, and thereby the one mechanism in engagement with the driven gear is driven. By using the switch gear and the set of driven gears, an arbitrary mechanism can be driven independently from the other mechanisms by a single motor.

For example, FIG. 28A shows a switch gear 200 and a set of driven gears 201 through 204. These gears configure the driving force transmitting device of an inkjet printer for the required set of functions. This inkjet printer has a first feeding tray and a second feeding tray. Moreover, this inkjet printer can execute normal printing and high-speed printing on sheets stored in the first feeding tray. Furthermore, this inkjet printer can perform maintenance on the inkjet head.

The switch gear 200 can slide in a direction shown by an arrow in FIG. 28A. The switch gear 200 is rotated by a driving force from a motor which is not shown. The driven gears 201 through 204 are planed rotatably around a rotation axis 205. The driven gears 201 through 204 can be driven independently. The driven gear 201 is engaged with the first mechanism, which rotates a feeding roller of the first feeding tray (referred to as "first feeding roller" hereinafter) intermittently, so as to send sheets intermittently from the first feeding tray. The driven gear 202 is engaged with the second mechanism, which rotates the first feeding roller continuously, so as to send the sheets continuously from the first feeding tray. The driven gear 203 is engaged with the third mechanism that rotates a feeding roller sending sheets from the second feeding tray (refined to as "second feeding roller" hereinafter). The driven gear 204 is engaged with the fourth mechanism that transmits driving force to a maintenance device.

The switch gear 200 can slide and thereby engage with any of the driven gears 201 through 204. When the driven gear is rotated by the switch gear 200, the mechanism of engagement with the driven gear is activated. The mechanism to be activated is changed by sliding the switch gear 200.

When normal printing is executed on sheets stored in the first feeding tray, the switch gear 200 is slid to a position for engagement with the driven gear 201. Consequently, the driving force from the motor is transmitted to the first feeding roller by the first mechanism. The first mechanism intermittently rotates the first feeding roller so as to send the sheets intermittently. Therefore, the sheets are sent intermittently from the first feeding tray. Specifically, after printing on the first sheet is finished, a subsequent sheet is sent from the first feeding tray. In the normal printing, an image can be printed on a sheet with a high degree of accuracy.

When high-speed printing is executed on sheets stored in the first feeding tray, the switch gear 200 is slid to a position for engagement with the driven gear 202. Consequently, the driving force from the motor is transmitted to the first feeding roller by the second mechanism. The second mechanism continuously rotates the first feeding roller so as to send the sheets continuously. Therefore, the sheets are sent continuously from the first feeding tray. Specifically, once the first sheet is sent from the first feeding tray, a subsequent sheet is sent from the first feeding tray. In the high-speed printing, an image can be printed on a number of sheets in a short amount of time.

The second feeding tray can store sheets that differ in size from the sheets stored in the first feeding tray. For example sheets of A4 size are stored in the first feeding tray, and sheets of B5 size are stored in the second feeding tray. A user can select the size of sheets and print an image on a sheet of the selected size.

When printing on the sheets stored in the second feeding tray, the switch gear 200 is slid to a position for engagement with the driven gear 203. Consequently, the driving force from the motor is transmitted to the second feeding roller by the third mechanism. Accordingly, the second feeding roller is rotated, and thereby a sheet is sent from the second feeding tray.

In the inkjet printer, ink droplets are ejected from the inkjet head, whereby an image is printed on a sheet. Specifically, an actuator (an actuator using a modification of piezoelectric element or electrostrictive element, an actuator that locally heats ink by means of a heater element, or other actuator) of the inkjet head is activated, and the ink droplets are ejected from a nozzle onto a sheet. In the inkjet printer, occasionally bubbles are generated in the ink in the inkjet head, or foreign material is adhered to the nozzle. In such cases, the inkjet head cannot eject ink droplets in the preferred manner. Therefore, the inkjet printer needs to perform maintenance on the inkjet head. When performing maintenance, the bubbles, foreign material and the like are drawn and eliminated from the nozzle of the inkjet head. This operation is generally called the "purge operation". The purge operation is executed when, for example, the power of the inkjet printer is ON, or at predetermined time intervals. The maintenance device for performing the purge operation has a cap covering a nozzle surface of the inkjet head, and a pump for reducing the pressure inside the cap.

When executing the purge operation, the inkjet head is stopped at a position corresponding to the maintenance device. Then, the nozzle surface of the inkjet head is covered with the cap. At the same time, the switch gear 200 is slid to a position for engagement with the driven gear 204. Consequently, the driving force from the motor is transmitted to the maintenance device by the fourth mechanism. Then, the pump of the maintenance device and the valve for switching the discharge destination of the pump are activated. Accordingly, the pressure inside the cap is reduced. When the pressure inside the cap is reduced, the bubbles, foreign material and the like are drawn out and removed from the nozzle.

As described above, by moving the position of the switch gear 200, the transmission destination of the driving force of the driving force transmitting device is changed.

BRIEF SUMMARY OF THE INVENTION

Normally, printers are manufactured and sold as a series ranging from a standard type to a highly-functional type. Therefore, even in the case of printers of the same series, functions thereof are different depending on the printer type. For example, a highly-functional type printer can execute normal printing, high-speed printing, and maintenance on the print head, and has the second feeding tray. However, a standard type printer does not have the second feeding tray. Also, there are types of printers that cannot execute high-speed printing.

Normally, common parts are used among the printer types of the same series. Therefore, when manufacturing a printer with a smaller number of functions, its driving force transmitting device is produced without the gears required for the omitted functions.

For example, FIG. 28B shows a set of driven gears of a driving force transmitting device of an inkjet printer of the same series but different type from the inkjet printer shown in FIG. 28A. This printer does not have the second feeding tray. Therefore, the set of driven gears shown in FIG. 28B are constructed without the driven gear 203 (the gear for transmitting the driving force to the second feeding roller) which is found in the set of driven gears shown in FIG. 28A.

As described above, a printer with a smaller number of functions has a smaller number of driven gears. This is because when a function is not necessary the driven gear required for that function is removed. However, if one driven gear is removed, the positions of other driven gears placed on the same axis (the positions in a direction parallel to the rotation axis) cannot be fixed. Therefore, when a printer has a smaller number of functions, a spacer needs to be placed in place of the unnecessary driven gear.

For example, in the inkjet printer shown in FIG. 28B, a spacer 206 is placed in place of the driven gear 203. By placing the spacer 206, the positions of the driven gears 201, 202, and 204 are fixed.

As described above, in conventional printers, a spacer had to be placed in place of an unnecessary driven gear when manufacturing a printer with a smaller number of functions. Therefore, this creates a problem, as the number of parts attached to the rotation axis of the driven gears can not be reduced even when the printer has a smaller number of functions.

The present invention provides a printer, which can use the same driven gears as other types of printer, however it does not require spacers even if the number of driven gears is reduced.

The present invention provides a pair of driven gears and a set of driven gears, which can be shared by a plurality of types of printers and do not have to be replaced with a spacer even if the number of driven gears is reduced.

The present invention provides a method of using the pair of driven gears for manufacturing a plurality of types of printers.

A printer according to the present invention comprises a switch gear, a first driven gear and a second driven gear. The switch gear has a spur gear and is able to slide along a direction that is parallel to a rotation axis of the spur gear. The first driven gear has a first spur gear and a cylinder fixed to the first spur gear. The cylinder is concentric with respect to the first spur gear and extends along the above direction. The second driven gear has a second spur gear with a hole that is concentric with respect to the second spur gear. The hole extends along the above direction. The second driven gear is mounted on the first driven gear by inserting the cylinder of the first driven gear into the hole of the second driven gear. The second driven gear is able to rotate with respect to the first driven gear. The switch gear slides along the above direction between a fist position for engagement with the first driven gear and a second position for engagement with the second driven gear.

In this printer, the cylinder of the first driven gear is concentric with respect to the rotation axis of the first spur gear. Also, the hole of the second driven gear is concentric with respect to the rotation axis of the second spur gear. By inserting the cylinder of the first driven gear into the hole of the second driven gear, the second driven gear is placed so as to be able to rotate with respect to the first driven gear. Therefore, the first driven gear and the second driven gear can rotate around the same rotation axis. Therefore, the switch gear can slide between the first position for engagement with the first driven gear and the second position for engagement with the second driven gear.

Moreover, the second driven gear is placed on the cylinder of the first driven gear. Therefore, even if the second driven gear is not placed, the position of the first driven gear in the abovementioned direction is not changed compared to the case where the second driven gear is placed. Specifically, the position of the first driven gear in the abovementioned direction is not changed by the presence and absence of the second driven gear. Therefore, it is not necessary to place a space in place of the second driven gear when the second driven gear is unnecessary.

The present invention also describes a pair of driven gears commonly used for manufacturing a first type of printer having a first mechanism and a second type of printer having the first and a second mechanism. The first driven gear is for engagement with the first mechanism. The second driven gear is for engagement with the second mechanism. The first driven gear has a first spur gear and a cylinder fixed to the first spur gear. The cylinder is concentric with respect to the first spur gear and extends along a direction that is parallel to the rotation axis of the first spur gear. The second driven gear has a second spur gear with a hole that is concentric with respect to the second spur gear. The hole extends along a direction that is parallel to the rotation axis of the second spur gear.

Only the first driven gear is used for manufacturing the first type of printer, and the first and second driven gears are used for manufacturing the second type of printer. In this case, the first and second driven gears are arranged such that the cylinder of the first driven gear is inserted into the hole of the second driven gear.

The pair of gears are placed inside the printer when manufacturing the printer. Only the first driven gear is used when manufacturing the first type of printer. Both the first driven gear and the second driven gear are used when manufacturing the second type of printer. In this case, the first driven gear and second driven gear are used in a stare in which the cylinder of the first driven gear is inserted into the hole of the second driven gear. Therefore, the first driven gear and the second driven gear can rotate around the same rotation axis. Further, since the second driven gear is placed on the cylinder of the first driven gear, the position of the first driven gear in the direction parallel to the rotation axis of the first spur gear is not changed by the presence and absence of the second driven gear. Therefore, it is not necessary to place a spacer in place of the second driven gear when, manufacturing the first type of printer.

The present invention also describes a set of driven gears commonly used for manufacturing a first type of printer having a first and a fourth mechanism, a second type of printer having the first, a second and the fourth mechanism, and a third type of printer having the first, the second, a third and the fourth mechanism. The first driven gear is for engagement with the first mechanism. The second driven gear is for engagement with the second mechanism. The third driven gear is for engagement with the third mechanism. The fourth driven gear is for engagement with the fourth mechanism. The first driven gear has a first spur gear and a cylinder fixed to the first spur gear. The cylinder of the first driven gear is concentric with respect to the first spur gear and extends along a direction that is parallel to the rotation axis of the first spur gear. The second driven gear has a second spur gear with a hole that is concentric with respect to the second spur gear. The hole of the second driven gear extends along a direction that is parallel to the rotation axis of the second spur gear. The third driven gear has a third spur gear with a hole that is concentric with respect to the third spur gear. The hole of the third driven gear extends along a direction that is parallel to the rotation axis of the third spur gear. The fourth driven gear has a fourth spur gear and a cylinder fixed to the fourth spur gear. The cylinder of the fourth driven gear is concentric with respect to the fourth spur gear and extends along a direction that is parallel to the rotation axis of the fourth spur gear.

Only the first and fourth driven gears are used for manufacturing the first type of printer. The first, second and fourth driven gears are used for manufacturing the second type of printer. The first, second, third and fourth driven gears are used for manufacturing the third type of printer.

In any case, the first and fourth driven gears are arranged such that the distal end of the cylinder of the first driven gear is in contact with the distal end of the cylinder of the fourth driven gear. When the second driven gear is used, the second driven gear is arranged such that the cylinder of the first driven gear is inserted into the hole of the second driven gear. When the third driven gear is used, the third driven gear is arranged such that the cylinder of the fourth driven gear is inserted into the hole of the third driven gear.

The set of gears are placed inside the printer when manufacturing the printer.

The first and fourth driven gears are used when manufacturing the first type of printer. When manufacturing the first type of printer, the first and fourth driven gears are arranged such that the distal end of the cylinder of the first driven gear is in contact with the distal end of the cylinder of the fourth driven gear.

The second driven gear is used when manufacturing the second type of printer. The second driven gear is arranged such that the cylinder of the first driven gear is inserted into the hole of the second driven gear. Therefore, the positional relationship between the first driven gear and the fourth driven gear is not changed by the presence or absence of the second driven gear.

The third driven gear is used when manufacturing the third type of printer. The third driven gear is arranged such that the cylinder of the fourth driven gear is inserted into the hole of the third driven gear. Therefore, the positional relationship between the first driven gear and the fourth driven gear is not changed by the presence or absence of the third driven gear.

As described above, when the set of driven gears are used, the positional relationship between the first driven gear and the fourth driven gear is not changed by the presence or absence of the second driven gear and the third driven gear. Therefore, when manufacturing the first type and second type of printers, it is not necessary to place a spacer in place of the second driven gear and the third driven gear.

The present invention also describes a method of using at least one of the following gears for manufacturing a first type of printer and a second type of printer. The gears comprise:

(1) a first driven gear having a first spur gear and a cylinder fixed to the first spur gear, the cylinder being concentric with respect to the first spur gear and extending along a direction that is parallel to the rotation axis of the first spur gear, (2) a second driven gear having a second spur gear with a hole that is concentric with respect to the second spur gear and extends along the direction.

The method comprises the steps of: mounting only the first driven gear within the first type of printer in order to manufacture the first type of printer, and mounting the first and second driven gears within the second type of printer in order to manufacture the second type of printer. In this case, the first and second driven gears are arranged such that the cylinder of the first driven gear is inserted into the hole of the second driven gear.

In the above method, only the first driven gear is used when manufacturing the first type of printer. Also, the first driven gear and the second driven gear are used when manufacturing the second type of printer. When manufacturing the second type of printer, the first and second driven gears are arranged such that the cylinder of the first driven gear is inserted into the hole of the second driven gear. In this manner, the second driven gear is placed in the cylinder of the first driven gear, thus the position of the first driven gear, which is in the direction parallel to the rotation axis of the first spur gear, is not changed by the presence or absence of the second driven gear. Therefore, when manufacturing the first type of printer, it is not necessary to place a spacer in place of the second driven gear.

DETAILED DESCRIPTION OF THE INVENTION

Hereinafter, embodiments of the present invention are described with reference to the drawings. Normally, there are a series of complex machines ranging from a general-purpose type machine, which has fewer functions, to an upper type machine, which has a number of functions. The functions of the complex machines vary according to the type of complex machine even if the complex machines are of the same series. A user selects an appropriate type for his intended purpose from the series of complex machines, and buys the selected type of machine. The complex machine 1 described hereinafter is a type of complex machine which has the largest number of functions in the series.

Figure 1:
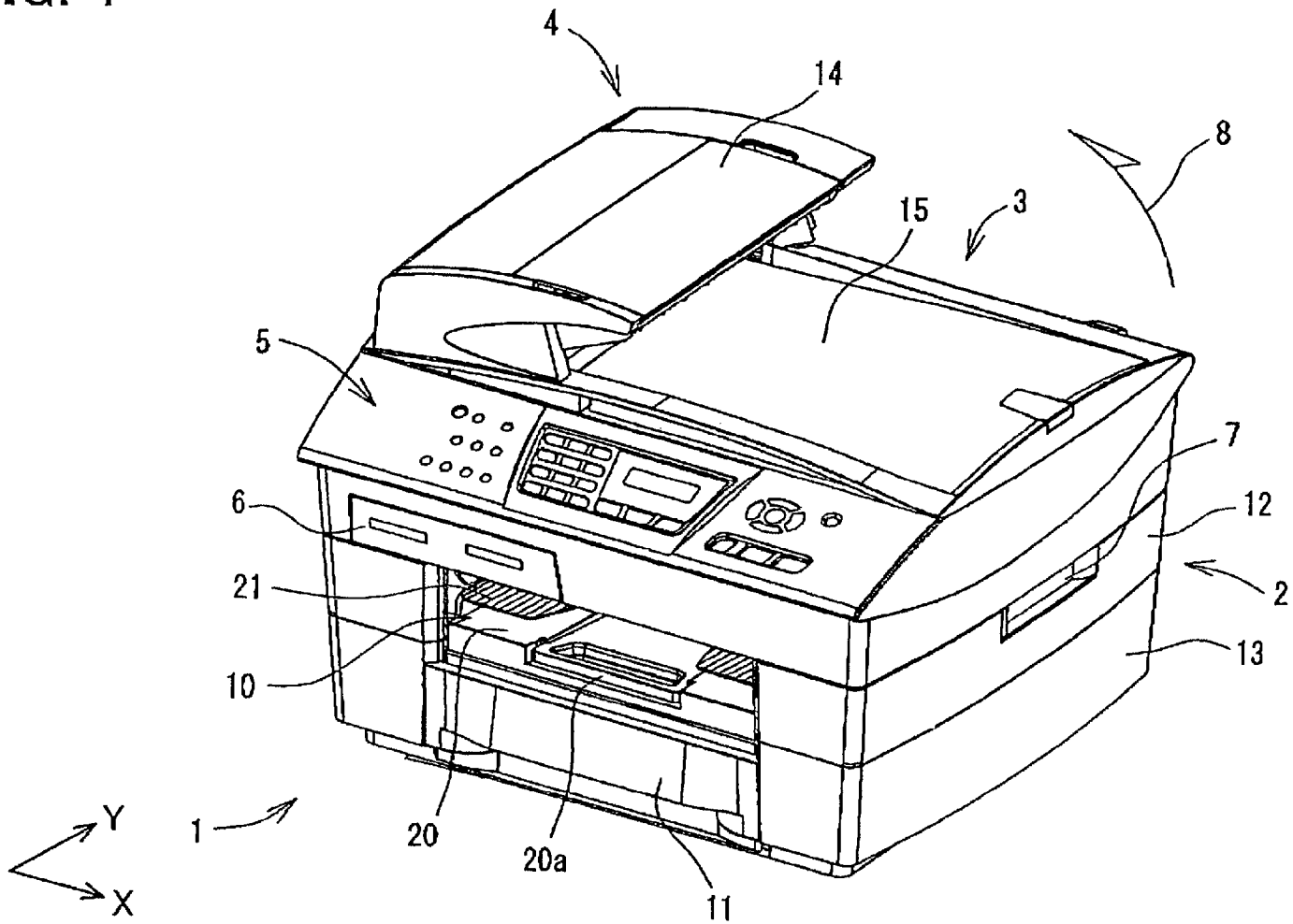
FIG. 1 is a perspective view showing an exterior view of a complex machine of an embodiment of the present invention.
Figure 2:
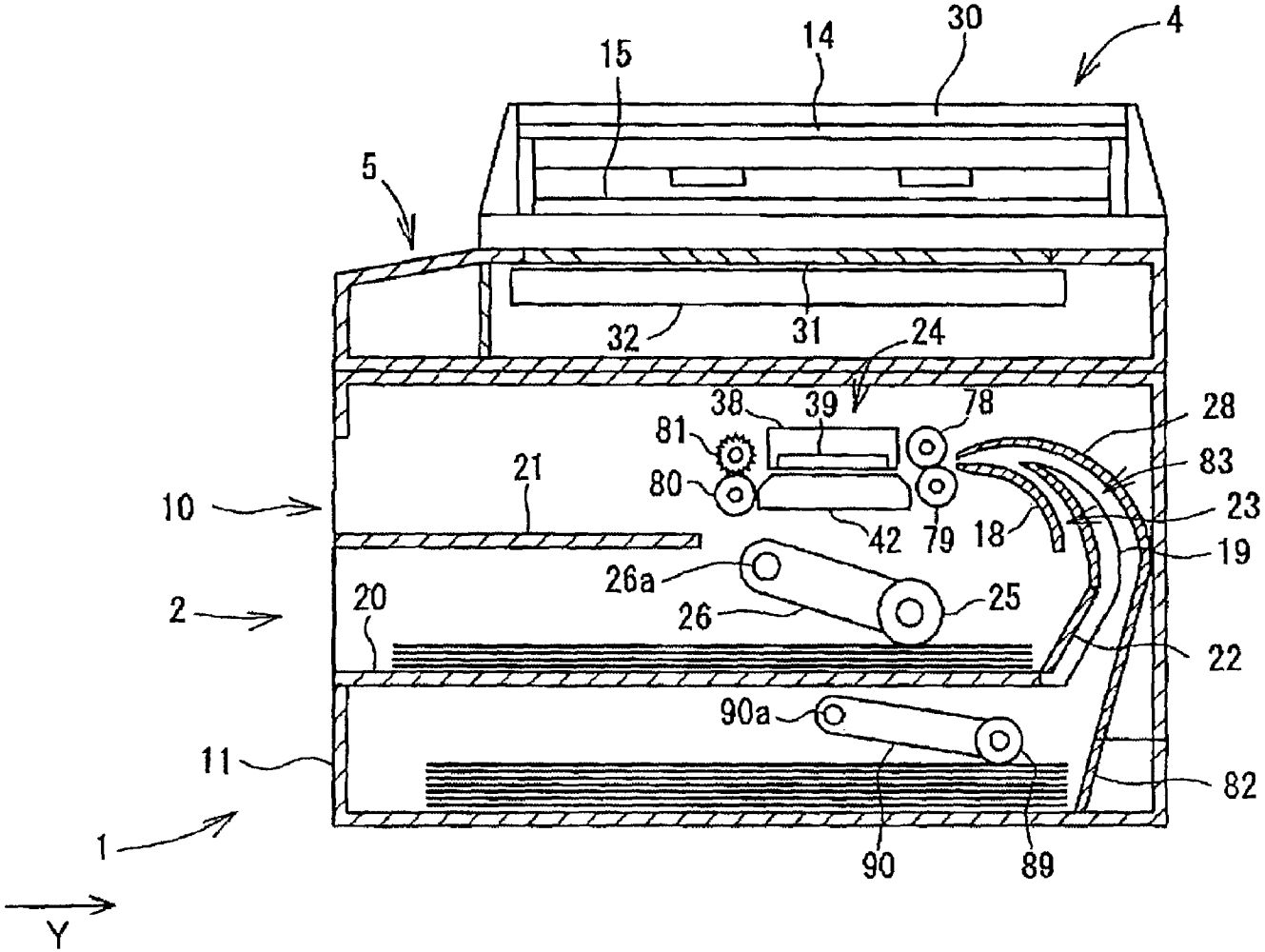
FIG. 2 is a schematic cross-sectional view showing an internal structure of the complex machine.

FIG. 1 is a figure showing an exterior view of the complex machine 1 of the present embodiment, and FIG. 2 is a schematic vertical cross-sectional view showing an internal structure of the complex machine 1. As shown in FIG. 1, the outer shape of the complex machine 1 is substantially a rectangular solid. The complex machine 1 has a scanner 3 in the upper section thereof, and a printer 2 in the lower section thereof. The complex machine 1 is a multi function device (MFD) which has a printer function, scanner function, copy function, and facsimile function. A control panel 5 is placed on the near side of the upper section of the complex machine 1. An external computer, digital camera, or the like can be connected to the complex machine 1. The complex machine 1 operates based on instructions inputted from the control panel 5 or the external computer. It should be noted that, hereinafter the direction from the left to the right of the complex machine 1 is referred to as the "X direction", and the direction from the near side to the back of the complex machine 1 is referred to as the "Y direction" (see FIG. 1).

The control panel 5 for controlling the printer 2 and scanner 3 is placed in the front upper section of the complex machine 1. The control panel 5 is constituted by various control buttons, a liquid crystal display screen, and the like. The control buttons include a button for turning the power ON and OFF, a start button for reading or printing an image, an operation stop button, a switch button for switching operation modes (the copy function, scanner function, facsimile function and the like), and a numerical keypad for performing various settings and inputting a fax number.

Also, a slot 6 for a memory card is placed in the left side lower section of the control panel 5. A memory card is inserted into the slot 6, and a predetermined manipulation is performed with the control panel 5, whereby the image data inside the memory card can be displayed on the liquid crystal display screen of the control panel 5. By manipulating the control panel 5 on the basis of the display, any image can be printed using the printer 2.

The scanner 3 is a flatbed scanner. The scanner 3 is constituted mainly by an original copy cover 30, a platen glass 31, and an image sensor 32 (see FIG. 2). The platen glass 31 is placed substantially horizontally in the upper section of the complex machine 1. The image sensor 32 is placed below the platen glass 31. The image sensor 32 is placed such that the Y direction is the main scanning direction (a direction in which a plurality of light receiving elements are arranged) and the X direction is the sub-scanning direction (a direction along which the image sensor 32 moves). The original copy cover 30 is placed above the platen glass 31. The original copy cover 30 is opened to set an original copy on the platen glass 31, whereby an image on the original copy can be read by the image sensor 32. Moreover, an auto document feeder (ADF) 4 is placed on the original copy cover 30. The ADF 4 has an original copy tray 14 which can store the plurality of original copies. The ADF 4 conveys original copies one-by-one from the original copy tray 14 onto the platen glass 31, and thereafter discharges the original copies to a catch tray 15. While the ADF 4 conveys the original copies, the image sensor 32 reads images of the conveyed original copies. It should be noted that in FIG. 1 the original copy tray 14 is folded up.

The printer 2 prints images or text on a paper on the basis of image data or document data which is inputted from the external computer, external digital camera, scanner 3, memory card inserted into the slot 6, and the like.

An opening 10 is formed on a front side of an upper side frame 12 of the printer 2. In a space inside the opening 10, a catch tray 21 is formed in an upper section and a feeding tray 20 is formed in a lower section. The feeding tray 20 can store a plurality of papers. Moreover, the feeding tray 20 can store papers of any size such as A4 size, B5 size, postcard size, or other size. Furthermore, by pulling a slide tray 20*a* of the feeding tray 20, papers of legal size or of relatively large size can also be stored. The papers stored on the feeding tray 20 are conveyed into the printer 2, and thereby images are printed. The papers with the printed images are discharged to the catch tray 21.

An opening is formed on the front side of the lower side frame 13 of the printer 2. A feeding tray 11 is placed within the opening. The feeding tray 11 can store papers of any size such as A4 size, B5 size, legal size, or other size. The feeding tray 11 can also store several times more papers than the feeding tray 20. Normally, the size of paper which is frequently used, such as A4 size,is stored in the feeding tray 11.

It should be noted that the lower side frame 13 is detachable with respect to the upper side frame 12. Among the types of complex machines which are a lower level than the complex machine 1, there are complex machines which do not have the lower side frame 13 (i.e., the feeding tray 11).

Next, the internal structure of the complex machine 1 is explained. As shown in FIG. 2, in the complex machine 1, there is a structure for sending papers to a printing unit 24, the printing unit 24 for printing an image on the papers, and a structure for discharging the papers on which the image is printed by the printing unit 24, to the catch tray 21. The structure for sending papers is constituted by a first feeding roller 25, a first feeding arm 26, a tilted plate 22, a first paper path 23, a second feeding roller 89, a second feeding arm 90, a tilted plate 82, a second paper path 83, a conveying roller 78, a pinch roller 79 and the like. The structure for discharging the papers is constituted mainly by a discharging roller 80, a spur roller 81 and the like.

<The Structure for Sending Papers to the Printing Unit 24>

In the feeding tray 20, the first feeding arm 26 is placed so as to be rotatable around a shaft 26*a*. The first feeding roller 25 is placed on a distal end of the first feeding arm 26. The first feeding arm 26 is biased in a lower direction by a spring or the like. Therefore, the first feeding roller 25 is in contact with the paper at the top of the feeding tray 20. The first feeding roller 25 rotates when driving force of a LF motor 107 is transmitted by a driving force transmitting device 220 which is described hereinafter. The tilted plate 22 is placed at the back of the feeding tray 20. The first paper path 23 is formed on the upper side of the tilted plate 22 by guide members 18, 19.

When the first feeding roller. 25 rotates in a direction feeding a paper, the paper at the top of the feeding tray 20 is sent to the tilted plate 22 side. The sent paper is brought into contact with the tilted plate 22 and then conveyed in an upper direction (i.e., to the first paper path 23). When two or more papers are sent from the feeding tray 20 to the tilted plate 22 side, the papers other than the very top sheet of paper are prevented from moving by the tilted plate 22. Therefore, only the very top paper sheet is conveyed to the first paper path 23. The paper conveyed to the first paper path 23 is conveyed to the conveying roller 78 and pinch roller 79 through the first paper path 23.

In the feeding tray 11, the second feeding arm 90 is placed so as to be rotatable around a shaft 90*a*. The second feeding roller 89 is placed on a distal end of the second feeding arm 90. The second feeding arm 90 is biased in a lower direction by a spring or the like. Therefore, the second feeding roller 89 is in contact with the paper at the top of the feeding tray 11. The second feeding roller 89 rotates when the driving force of the LF motor 107 is transmitted by the driving force transmitting device 220. The tilted plate 82 is placed at the back of the feeding tray 11. The second paper path 83 is formed on the upper side of the tilted plate 82 by the guide member 19 and a guide member 28. The second paper path 83 merges with the first paper path 23.

When the second feeding roller 89 rotates, the paper at the top of the feeding tray 11 is conveyed to the conveying roller 78 and pinch roller 79 via the tilted plate 82 and second paper path 83, as with the paper on the feeding tray 20.

The conveying roller 78 and pinch roller 79 are placed on the downstream end of the first paper path 23 (which is also the downstream end of the second paper path 83). The conveying roller 78 is rotated intermittently by the driving force of the LF motor 107. A rotary encoder 112 (see FIG. 9) is placed on the conveying roller 78. The rotary encoder 112 optically detects a rotation amount of the conveying roller 78. The rotation of the conveying roller 78 is controlled based on a value detected by the rotary encoder 112. The pinch roller 79 is biased in the direction of the conveying roller 78 by a coil spring which is not shown, and is in contact with the conveying roller 78. The pinch roller 79 is supported rotatably. Therefore, the pinch roller 79 rotates with the rotation of the conveying roller 78.

The paper which is sent from the first paper path 23 or second paper path 83 is guided between the conveying roller 78 and the pinch roller 79. As described above, the conveying roller 78 rotates intermittently. Therefore, the paper is held between the conveying roller 78 and the pinch roller 79 and then conveyed intermittently to the printing unit 24 side. The paper conveyed to the printing unit 24 passes between the printing unit 24 and a platen 42, and is conveyed to the discharging roller 80 and spur roller 81. It should be noted that resist processing is performed when the paper passes through the conveying roller 78 and pinch roller 79.

<The Printing Unit 24>

The printing unit 24 and the platen 42 are placed on the downstream side of the conveying roller 78 and pinch roller 79. The printing unit 24 is constituted by a carriage 38 moving in the X direction and an inkjet head 39 placed on the bottom surface of the carriage 38.

Figure 3:
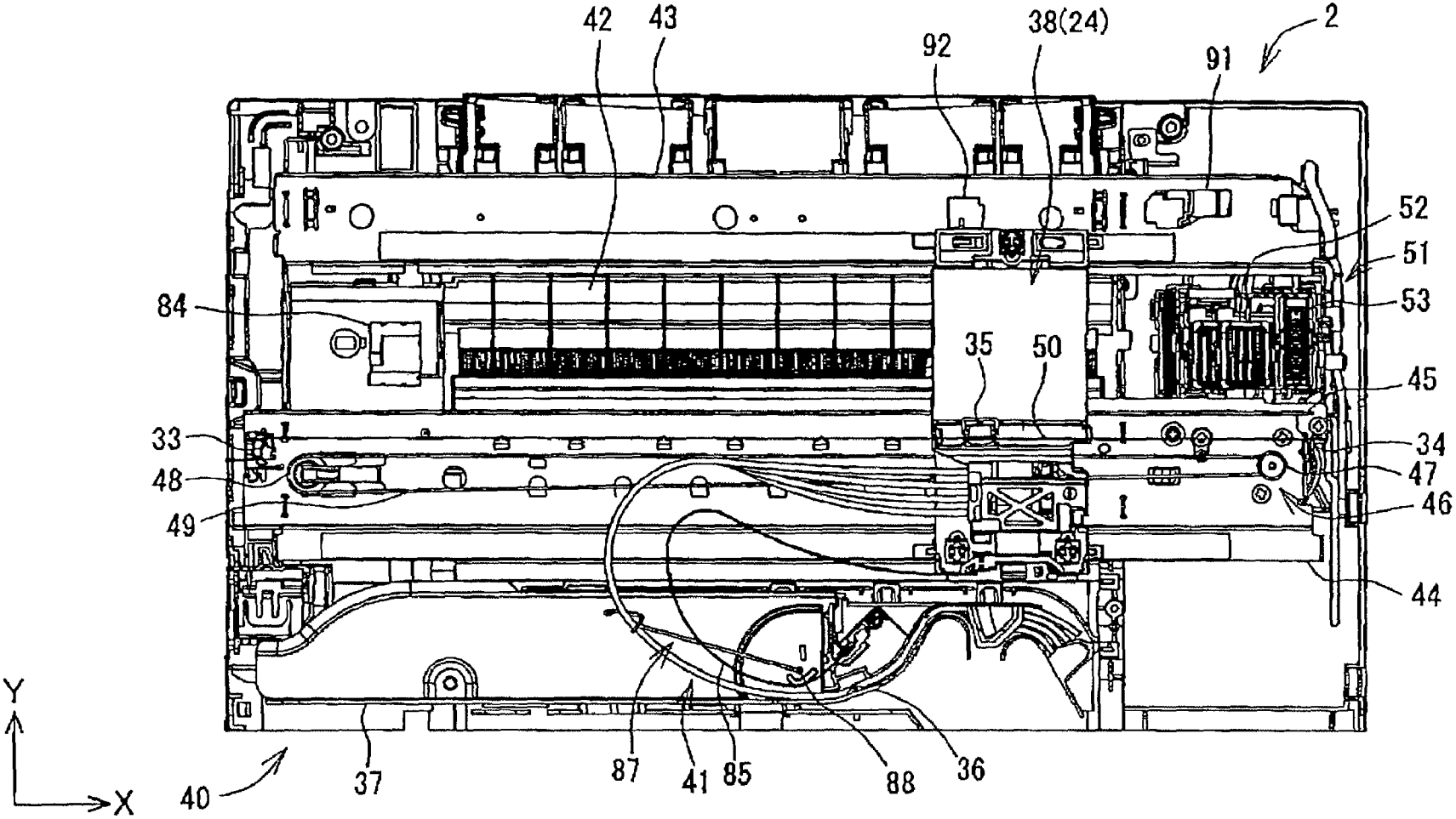
FIG. 3 is a plan view showing an internal structure of a printer.

FIG. 3 is a plan view showing a main structure of the printer 2. FIG. 3 mainly shows a structure between substantially the center of the printer 2 and the bottom thereof. Although not shown, the conveying roller 78 and the pinch roller 79 are placed on the upper side of FIG. 3, and papers are conveyed from the upper side to the lower side of the FIG. 3 at the time of printing. As shown in FIG. 3, a pair of guide rails 43, 44, which are separated from each other by a predetermined distance, are placed within the printer 2. The guide rails 43, 44 extend in the X direction. The guide rails 43, 44 are part of a frame 40 of the printer 2. The guide rails 43, 44 are in the form of a flat plate. The length of the guide rails 43, 44 is longer than the width of the widest type of paper that might possibly be conveyed. An end section 45 of the guide rail 44 is bent in a vertical direction. The carriage 38 bridges from the guide rail 43 to the guide rail 44. Specifically, a groove (not shown), which is formed on the bottom surface of the carriage 38, is in engagement with the end section 45 of the guide rail 44, and the bottom surface of the carriage 38 is in contact with the guide rails 43, 44. In the carriage 38, a roller and the like are placed in the section which is in contact with the guide rails 43, 44. Accordingly, the carriage 38 can reciprocate along the X direction within the range of the length of the guide rails 43, 44. Therefore, the carriage 38 can reciprocate along the entire width of the paper to be conveyed.

A belt driving device 46 is placed on a top surface of the guide rail 44. The belt driving device 46 is constituted by a driving pulley 47, a driven pulley 48, and a timing belt 49. The driving pulley 47 and the driven pulley 48 are placed on both ends of the guide rail 44 (both ends in the X direction). The driving pulley 47 is rotated by a driving force of a CR motor 109 (see FIG. 9) which is described hereinafter. The timing belt 49 is a circular belt and is placed around the driving pulley 47 and driven pulley 48 so that the timing belt 49 can be rotated around the driving pulley 47 and, driven pulley 48. Irregular teeth are formed on the inside of the timing belt 49. The carriage 38 is fixed To the timing belt 49. When the driving pulley 47 rotates, the timing belt 49 rotates around the driving pulley 47 and driven pulley 48. Accordingly, the carriage 38 moves along the X direction. As described above, the inkjet head 39 is placed on the bottom surface of the carriage 38. Therefore, the inkjet head 39 also moves along the X direction.

An encoder strip 500 is placed on the guide rail 44. The encoder strip 50 is a strip-shaped plate made of transparent resin. The length of the encoder strip 50 is orientated in the X direction. The encoder strip 50 is placed such that the width of the strip is orientated in the vertical direction and the thickness is orientated in the Y direction. The encoder strip 50 is fixed to supporting sections 33, 34, in a state in which both end sections of the encoder strip 50 are pulled. Accordingly, the encoder strip 50 is prevented from being slackened. A pattern for blocking light is formed on the surface of the encoder strip 50. The encoder strip 50 is placed so that the encoder strip 50 engages with the detection section of optical sensor 35 which is placed on the top surface of the carriage 38. The optical sensor 35 has a light emitting element and a light receiving element. The optical sensor 35 uses the light receiving element to detect light emitted by the light emitting device, and thereby detects whether the light is blocked or not, by using the detection section. When the carriage 38 moves along the X direction, the pattern of the encoder strip 50 is detected as a pulse signal by the optical sensor 35. The pulse signal detected by the optical sensor 35 is read by a main control board which is described hereinafter. The main control board computes the position of the carriage 38 on the basis of the read pulse signal. Specifically, a linear encoder 113 is formed by the optical sensor 35 and the encoder strip 50. The main control board drives the CR motor 109 to control the position of the carriage 38, in accordance with the computed position of the carriage 38.

As described above, the inkjet head 39 is placed on the bottom surface of the carriage 38. The inkjet head 39 is connected to an ink cartridge by four ink tubes 41 (see FIG. 3).

The four ink tubes 41 are synthetic resin tubes. The ink tubes 41 connect the inkjet head 39 to the ink cartridge. The vicinity of an end section of each ink tube 41 on the inkjet head 39 side is fixed to the carriage 38. The middle section of each of the four ink tubes 41 is fixed to the frame 40 of the printer 2 by a clip 36. A section of each ink tube 41 between the carriage 38 and the clip 36 is sufficiently slackened. Moreover, the section of the ink tube 41 between the carriage 38 and the clip 36 is supported by a supporting member 87. The supporting member 87 can rotate horizontally around an axis 88. Accordingly, the ink tubes 41 are prevented from disengaging as the carriage 38 travels along the X direction. Also, in the frame 40 of the printer 2, a wall 37 is formed in the vicinity of the ink tubes 41. The height of the wall 37 corresponds to the four ink tubes 41. The wall 37 prevents the ink tubes 41 from protruding into the outer region of the printer 2. Also, a flat cable 85 is attached inside the printer 2 in the same manner as the ink tubes 41. The flat cable 85 is a wiring member formed by covering a plurality of conductive lines transmitting electrical signals with a polyester film. The flat cable 85 electronically connects a head control board to the main control board which is described hereinafter.

A cartridge attachment location is formed inside the printer 2. As shown in FIG. 1, a section above a grip 7 of the complex machine 1 can be rotated relatively in the direction of the arrow 8 with respect to a section below, the grip 7. Accordingly, the cartridge attachment location inside the printer 2 is exposed. Although not shown, the cartridge attachment section has four storage chambers. Ink cartridges for colors of cyan (C), magenta (M), yellow (Y) and black (Bk) are stored in each of the storage chambers. The ink tubes 41 are connected one-by-one to each cartridge. Therefore, ink is supplied from each cartridge to the inkjet head 39. Specifically, four colors of inks: cyan, magenta, yellow, and black, are supplied to the inkjet head 39.

Figure 8:
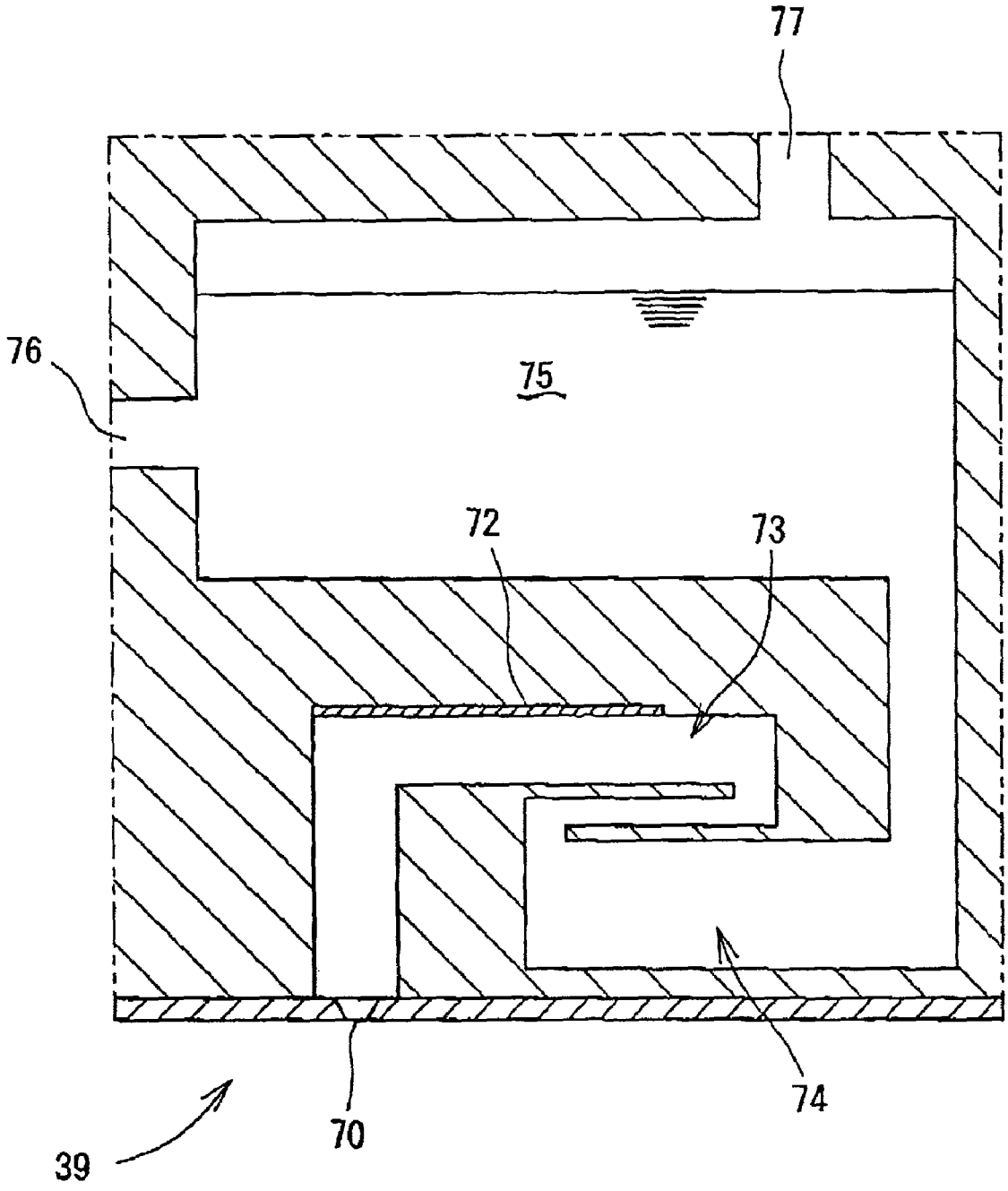
FIG. 8 is a view showing a frame format of an enlarged cross section of a part of the inkjet head.

FIG. 8 is a view showing a frame format of an enlarged cross section of part of the inkjet head 39. As shown in FIG. 8, opening 76 for receiving the ink supplied from the ink tubes 41, and a buffer tank 75 for accumulating the supplied ink are formed inside the inkjet head 39. The opening 76 and the buffer tank 75 are formed for each color independently. Moreover, a plurality of manifolds 74, whose upstream ends are connected to the buffer tanks 75 respectively, are formed inside the inkjet head 39. The downstream side of each of the manifolds 74 branches off in a plurality of directions. Each of the branch flow paths is opened to a bottom surface of the inkjet head 39. The opening of the each branch flow path is constituted as a nozzle 70 for ejecting ink droplets. A cavity 73 is formed in the middle of the each branch flow path. As shown in the figure, the manifolds 74 and the branch flow paths are filled with the ink. A piezoelectric element 72 is placed on a top surface of the cavity 73. The piezoelectric element 72 is deformed when predetermined voltage is applied thereto. When the piezoelectric element 72 is deformed, the volume of the cavity 73 decreases.

Figure 7:
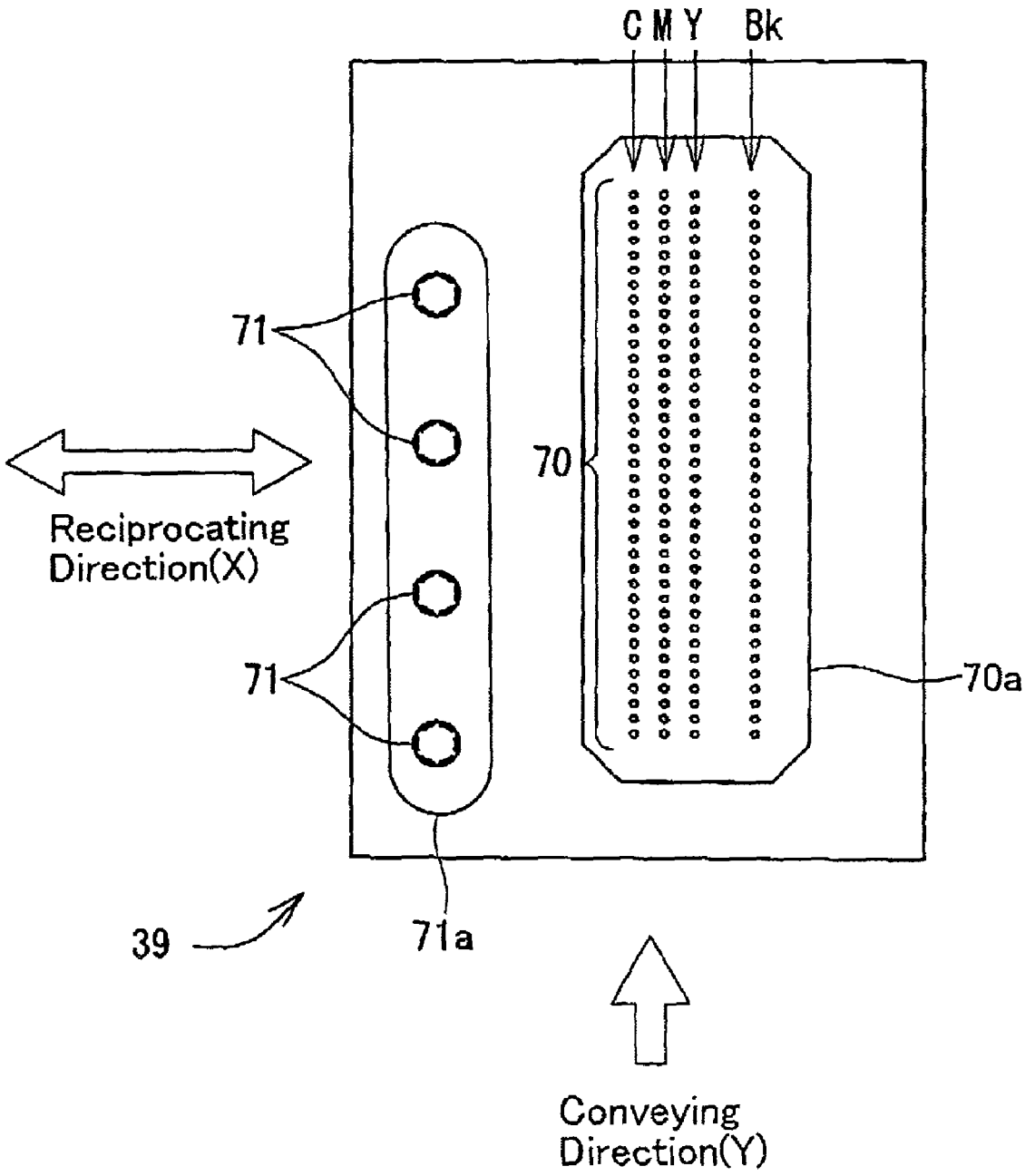
FIG. 7 is a plan view showing a bottom surface of an inkjet head.

FIG. 7 shows the bottom surface of the inkjet head 39. As shown in the figure, a number of nozzles 70 are formed on the bottom surface of the inkjet head 39. The abovementioned branch flow path is formed for each nozzle. The nozzles 70 are arranged in the Y direction for each color of ink to be ejected. Also, a row of nozzles for each color is arranged in the X direction. The pitch of the nozzles 70 for each color is determined in accordance with the resolution and the like of the printer 2.

The ink supplied from the ink tubes 41 to the inkjet head 39 is accumulated in the buffer tanks 75. Bubbles in the ink float upward in each of the buffer tanks 75. Therefore, ink with relatively less bubbles is present in the lower section of the buffer tank 75. The ink inside the buffer tank 75 flows out from the lower section into each manifold 74. Therefore, the bubbles are prevented from flowing into the manifold 74. The ink that flowed into the manifold 74 then flows into each branch flow path. Voltage is applied from the head control board to the piezoelectric element 72 at the time of printing. Consequently, the piezoelectric element 72 is deformed, and the volume of the cavity 73 decreases. Accordingly, the ink inside the cavity 73 is pressurized, and thereby ink droplets are, ejected from the nozzles 70.

Moreover, as shown in FIG. 8, a discharge flow path 77, one end of which is connected to the buffer tank 75, is formed inside the inlet head 39. The other end of the discharge flow path 77 is connected to a discharge port 71 shown in FIG. 7.

The discharge flow path 77 and the discharge port 71 are formed for each color (i.e., for each buffer tank 75). A check valve, which is not shown, is placed in each discharge port 71. This check valve is opened by inserting a rod 60 of a purging device 51 when maintenance is performed, the purging device 51 being described hereinafter. The air inside the buffer tank 75 (including the bubbles) is drawn and eliminated by the purging device 51.

As shown in FIG. 2 and FIG. 3, the platen 42 is placed on the lower side of the printing unit 24. The platen 42 is placed in a central part of the moving range of the carriage 38, the central part being a section through which a paper passes. The width of the platen 42 (width of the X direction) is wider than the width of a paper to be conveyed (the width of a paper, which is the widest among the papers which might be conveyed).

As described above, a paper to be conveyed by the conveying roller 78 and pinch roller 79 passes between the printing unit 24 and the platen 42. At this moment, the position of the carriage 38 in the X direction is controlled, and voltage is applied to each piezoelectric element 72 of the inkjet head 39. Accordingly, ink droplets are ejected from the nozzles 70. Paper feed rate, the position of the carriage 38, and the nozzles 70 ejecting ink droplets are controlled in accordance with an image to be printed. Therefore, an image is printed on a paper by an ink droplet ejected from each nozzle 70.

<The Structure for Discharging Papers to the Catch Tray 21>

The discharging roller 80 and the spur roller 81 are placed on the downstream side of the printing unit 24 and platen 42. The discharging roller 80 is rotated intermittently by the driving force of the LF motor 107. Rotation of the discharging roller 80 is synchronized with rotation of the conveying roller 78. Concavities and convexities are formed on the surface of the spur roller 81. The spur roller 81 is biased in the direction of the discharging roller 80 by a coil spring which is not shown, and is in contact with the discharging roller 80. The spur roller 81 is supported so as to be able to rotate freely. Therefore, the spur roller 81 rotates with rotation of the discharging roller 80.

The discharging roller 80 and the spur roller 81 convey a paper that has passed through the printing unit 24 to the catch tray 21. The paper that has passed through the printing unit 24 is held between the discharging roller 80 and the spur roller 81, and conveyed intermittently to the catch tray 21. It should be noted that an image is printed on an upper surface of the paper that has passed through the printing unit 24. Therefore, the spur roller 81 is brought into contact with the section of the paper where the image is printed. However, since the concavities and convexities are formed on the surface of the spur roller 81, distortion of the image, which is caused by contact with the spur roller 81, is prevented from occurring.

As described above, the printer 2 prints an image on the papers stored in the feeding tray 20 or the feeding tray 11. It should be noted that, when printing an image on the papers stored in the feeding tray 11, the printer 2 can perform the printing in two modes: normal print mode and high-speed print mode (i.e., a mode in which the intervals for conveying the papers are set shorter than those of the normal print mode, to print an image). In the normal print mode, a printed paper is discharged to the catch tray 21, and thereafter the next paper is sent from the feeding tray 20. In the high-speed print mode, on the other hand, immediately after a paper is sent from the feeding tray 20, the next paper is sent. In the high-speed print mode, the interval between papers is shorter than that in the normal print mode, thus a number of papers can be printed in a short amount of time.

<The Purging Device 51 and a Waste Ink Tray 84>

As shown in FIG. 3, the purging device 51 is placed on a right end of the moving range of the printing unit 24 (the position through which a paper does not pass). Also, a waste ink tray 84 is placed on a left end of the moving range of the printing unit 24 (the position through which the paper does not pass).

Figure 4:
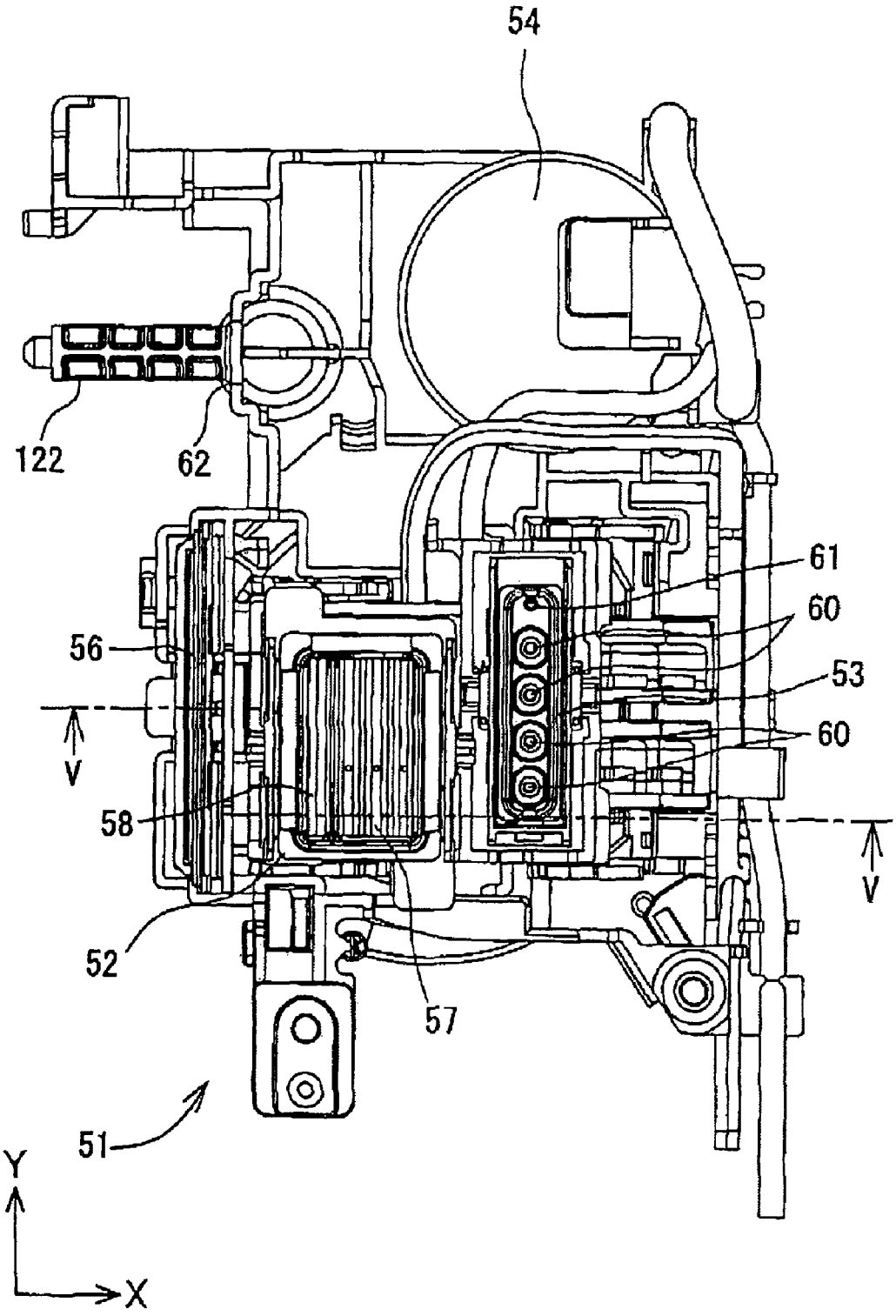
FIG. 4 is a plan view of a purging device.
Figure 5:
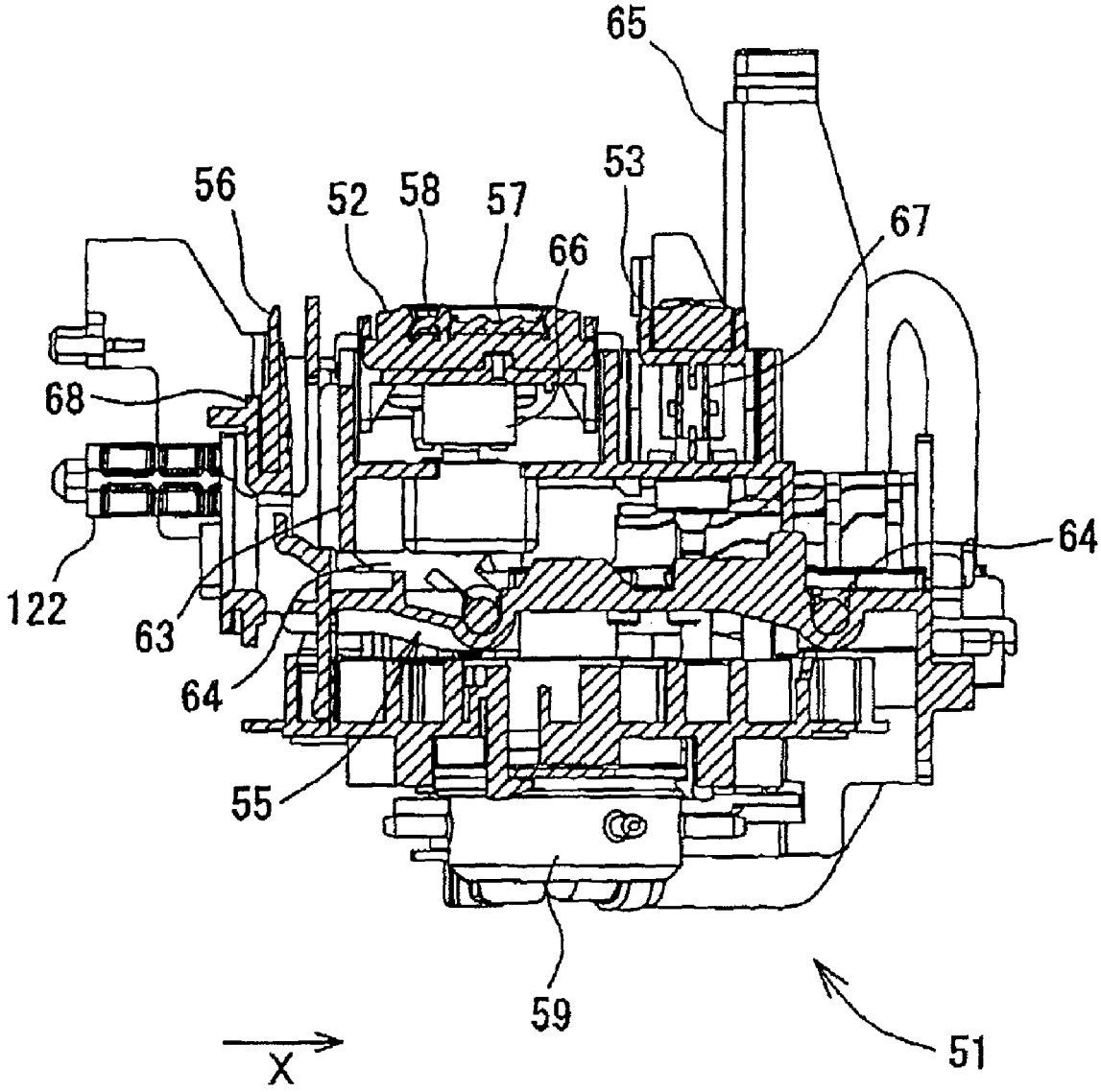
FIG. 5 is a cross-sectional view taken along the line V-V of FIG. 4.
Figure 6:
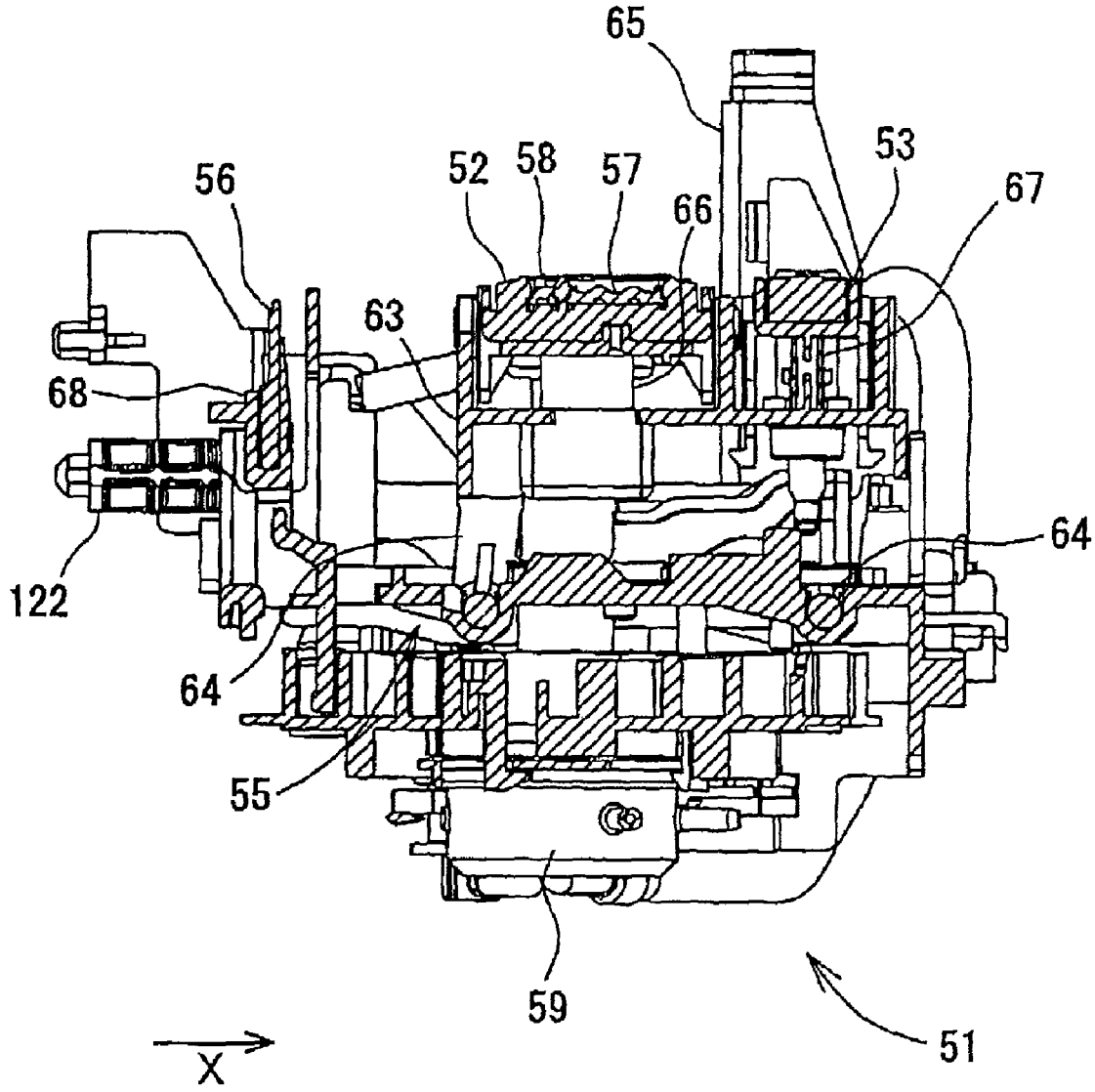
FIG. 6 is a cross-sectional view of the purging device in which a discharge cap is lifted up, the cross-sectional view being taken along the line V-V.

FIG. 4 is a plan view off the purging device 51. FIG. 5 is a V-V cross-sectional view of FIG. 4. FIG. 6 shows the purging device 51 in which a nozzle cap 52 and a discharge cap 53 are lifted up. The purging device 51 draws and eliminates bubbles or foreign material from the inkjet head 39. As shown in FIGS. 4 through 6, the purging device 51 has the nozzle cap 52, discharge cap 53, a pump 54, a lift-up device 55, and a wiper blade 56.

The nozzle cap 52 is a rubber cap, which is shaped so as to be sealable around a nozzle surface 70*a* (a region 70*a* in FIG. 7) of the inkjet head 39. The inside of the nozzle cap 52 is divided into a region corresponding to the nozzles 70 ejecting the color inks (the nozzles 70 for CMY shown in FIG. 7) and a region corresponding to the nozzle 70 ejecting the black ink (the nozzle 70 for Bk shown in FIG. 7). Members 57, 58 for supporting the nozzle cap 52 are embedded in the two regions respectively. Also, air inlets are formed on a bottom section of each region. Each of the air inlets is connected to a port switching device 59 via an inlet passage.

The discharge cap 53 is a rubber cap, which is shaped so as to be scalable around the region where four discharge ports 71 of the inkjet head 39 are formed (a reference numeral 71*a* in FIG. 7). In the discharge cap 53, the push rod 60 is placed in a position corresponding to each discharge port 71. Each push rod 60 extends vertically upward. Each push rod 60 can move in a vertical direction. An air inlet 61 is formed on a bottom section of the discharge cap 53. The air inlet 61 is connected to the port switching device 59 via an inlet passage.

The port switching device 59 is connected to an inlet passage connected to each air inlet of the nozzle cap 52 (referred to as "inlet passage of the nozzle cap 52" hereinafter), an inlet passage connected to the air inlet 61 of the discharge cap 53 (referred to as "inlet passage of the discharge cap 53" hereinafter), and an inlet passage connected to the pump 54 (referred to as "inlet passage of the pump 54" hereinafter). The port switching device 59 switches between a state in which the inlet passage of the nozzle cap 52 is connected to the inlet passage of the pump 54 and a state in which these inlet passages rare blocked. Moreover, the port switching device 59 switches between a state in which the inlet passage of the discharge cap 53 is connected to the inlet passage of the pump 54 and a state in which these inlet passages are blocked.

The pump 54 is a rotary pump. The pump 54 is connected to the port switching device 59 via an inlet passage. The pump 54 has a pump gear. The pump gear is in engagement with a bevel gear 62 shown in FIG. 4. The pump gear is rotated by rotation of the bevel gear 62. When the pump gear is rotated the pump 54 draws the liquid (and gas) inside the inlet passage to reduce the pressure inside the inlet passage. The bevel gear 62 is rotated when the driving force of the LF motor 107 is transmitted by the driving force transmitting device 220.

The lift-up device 55 moves a holder 63 to which the nozzle cap 52 and discharge cap 53 are fixed. The lift-up device 55 uses a rotating member 64 to rotate the holder 63 between a waiting position shown in FIG. 5 and an adhesion position shown in FIG. 6. The holder 63 is normally biased by a spring and fixed to the waiting position. The lift-up device 55 has a lever 65. Although described hereinafter, the carriage 38 contacts with the lever 65 when the carriage 38 moves to a position at a right end of FIG. 3. When the carriage 38 contacts with the lever 65, the holder 63 is moved from the waiting position to the adhesion position by the lift-up device 55. When the holder 63 is moved to the adhesion position, the nozzle cap 52 and discharge cap 53 adhere to the inkjet head 39. At this moment, the nozzle cap 52 and discharge cap 53 are pressed against the inkjet head 39 by coil springs 66, 67. Accordingly, the airtightness within the nozzle cap 52 and within the discharge cap 53 is maintained.

The wiper blade 56 is normally stored in a wiper holder 68. The wiper blade 56 can move upward from the wiper holder 68. The wiper blade 56 is a plate member made of rubber. When the wiper blade 56 protrudes from the wiper holder 68 at the time that the carriage 38 is at the right end of FIG. 3, the end section of the wiper blade 56 makes contact with the bottom surface of the inkjet head 39. When the carriage 38 is moved to the left of FIG. 3 in such a state, the bottom surface of the inkjet head 39 is wiped by the wiper blade 56.

When drawing and eliminating bubbles, foreign material and the like from the inkjet head 39, the carriage 38 moves to the position at the right end of FIG. 3. Accordingly, the inkjet head 39 is moved to the position right above the purging device 51. At this moment, since the carriage 38 contacts with the lever 65, the holder 63 moves from the waiting position to the adhesion position. Accordingly, the nozzle cap 52 and discharge cap 53 adhere to the inkjet head 39. In this state, bubbles, foreign mattes and the like are drawn from the nozzle 70 or discharge port 71.

When drawing bubbles, foreign material and the like from the nozzle 70, the inlet passage of the nozzle cap 52 is connected to the inlet passage of the pump 54 by the port switching device 59. Then, the driving force of the LF motor 107 is transmitted to the pump 54 by the driving force transmitting device 220. Accordingly, the pump 54 executes drawing, whereby bubbles, foreign material and the like are drawn along with ink from each nozzle 70.

When drawing bubbles, foreign material and the like from the discharge port 71, the inlet passage of the discharge cap 53 is connected to the inlet passage of the pump 54 by the port switching device 59. Then, the driving force of the LF motor 107 is transmitted to the pump 54 by the driving force transmitting device 220. Accordingly, the pump 54 executes drawing, whereby bubbles, foreign material and the like are drawn along with ink from each discharge port 71.

When the drawing operation has ended, the carriage 38 is moved to the left of FIG. 3. When the carriage 38 separates from the lever 65, die holder 63 moves to the waiting position. Consequently, the wiper blade 56 protrudes outward and makes contacts with the bottom surface of the inkjet head 39. The carriage 38 is then moved, whereby inks adhered to the bottom surface of the inkjet head 39 are wiped by the wiper blade 56.

As shown in FIG. 3, the waste ink tray 84 is placed in the position at a left end of the moving range of the printing unit 24 (the position through which a paper does not pass). In order to prevent jamming of the nozzles 70 of the inkjet head 39, sometimes ink droplets are ejected from the nozzles 70 at times other than printing (referred to as "flashing" hereinafter). The waste ink tray 84 receives ink droplets ejected by flashing. A felt is laid inside the waste ink tray 84. The ink droplets ejected by flashing are absorbed into the felt.

<The Control System of the Complex Machine 1>

Figure 9:
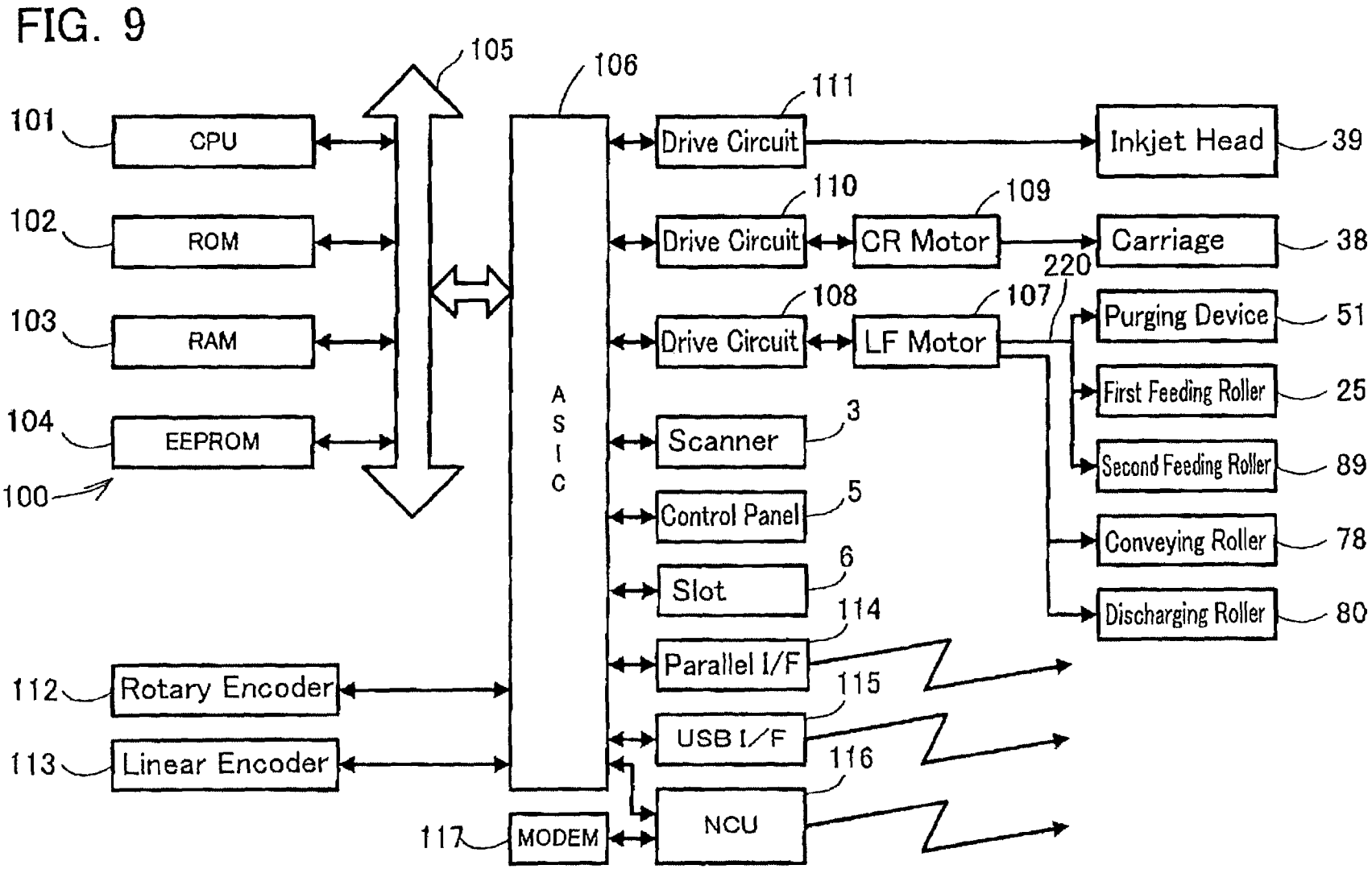
FIG. 9 is a block diagram showing the structure of a control section of the complex machine.

FIG. 9 is a block diagram showing the control system of the complex machine 1. A control section 100 controls the entire complex machine 1 comprising the printer 2 and scanner 3. It should be noted that the control of the scanner 3 is not a part of the main structure of the present invention, thus the explanation thereof is omitted. The control section 100 is constituted by a microcomputer having a CPU (Central Processing Unit) 101, ROM (Read Only Memory) 102, RAM (Random Access Memory) 103, EEPROM (Electrically Erasable and Programmable ROM) 104. The microcomputer is connected to an ASIC (Application Specific Integrated Circuit) 106 via a bus 105.

The programs and the like for controlling various operations of the complex machine 1 are stored in the ROM 102. For example, a program controlling each part of printer 2 in the normal printing mode and the high-speed printing mode is stored in the ROM 102. Also, a program controlling each part of printer 2, which is used for printing the papers stored in the feeding tray 11 and performing the purging operation, is stored in the ROM 102. The RAM 103 temporarily stores various data items which are used when the CPU 101 executes the programs. For example, when printing an image, data indicating the conditions for conveying papers and the printing resolution, are stored temporarily in the RAM 103. Further, the EEPROM 104 stores setting, flags, and the like which should be kept after turning off the power.

The ASIC 106 is connected to the control section 100 and each part of the complex machine 1. The ASIC 106 outputs a control signal to each part of the complex machine 1 in accordance with a command sent from the control section 100. The control section 100 and ASIC 106 are mounted on the main control board which is not shown.

A drive circuit 108 is connected to the ASIC 106 and the LF motor 107. The drive circuit 108 controls the drive of the LF motor 107 in response to the control signal inputted from the ASIC 106.

The LF motor 107 is a motor controlled by the drive circuit 108. The driving force of the LP motor 107 is transmitted to the conveying roller 78 and discharging roller 80. When printing is executed, the ASIC 106 computes a rotation amount for the conveying roller 78 and for the discharging roller 80 from the detection signal from the rotary encoder 112. Then, the ASIC 106 outputs a control signal to the drive circuit 108 in accordance with the computed rotation amount. The drive circuit 108 drives the LF motor 107 in response to the inputted control signal. Therefore, the rate at which a paper is fed by the conveying roller 78 and discharging roller 80 is controlled.

Moreover, the driving force of the LF motor 107 is transmitted to the purging device 51, first feeding roller 25, or second feeding roller 89 by the driving force transmitting device 220. The driving force transmitting device 220 switches the destination for transmitting the driving force of the LF motor 107 (i.e., the purging device 51, first feeding roller 25, or second feeding roller 89).

A drive circuit 110 controls the drive of the CR motor 109 in response to the control signal inputted from the ASIC 106. The driving force of the CR motor 109 is transmitted to the belt driving device 46. Accordingly, the carriage 38 is moved. Furthermore, the ASIC 106 computes the position of the carriage 38 from a detection signal detected by the linear encoder 113. The ASIC 106 inputs a control signal to the drive circuit 110 in accordance with the computed position of the carriage 38. The drive circuit 110 controls the drive of the CR motor 109 in response to the inputted control signal. Accordingly, the position of the carriage 38 is controlled.

A drive circuit 111 is mounted on the head control board. A control signal is inputted from the ASIC 106 into the drive circuit 111 via the flat cable 85. The drive circuit 111 controls each piezoelectric element 72 of the inkjet head 39 in response to the control signal inputted from the ASIC 106. Specifically, the drive circuit 111 controls the ejection of ink droplets performed by the inkjet head 39.

Moreover, the scanner 3, the control panel 5, the slot 6, a parallel interface 114, a USB interface 115, and a NCU (Network Control Unit) 116 are connected to the ASIC 106. External equipment such as a personal computer is connected to the parallel interface 114 and USB interface 115. The NCU 116 is connected to a MODEM 117 and an external line.

<The Driving Force Transmitting Device 220>

As described above, the driving force transmitting device 220 transmits the driving force of the LP motor 107 to the purging device 51, first feeding roller 25, or second feeding roller 89. The driving force transmitting device 220 switches the driving method of the first feeding roller 25 between the normal printing mode and the high-speed printing mode. The driving force transmitting device 220 is described hereinafter.

Figure 10:
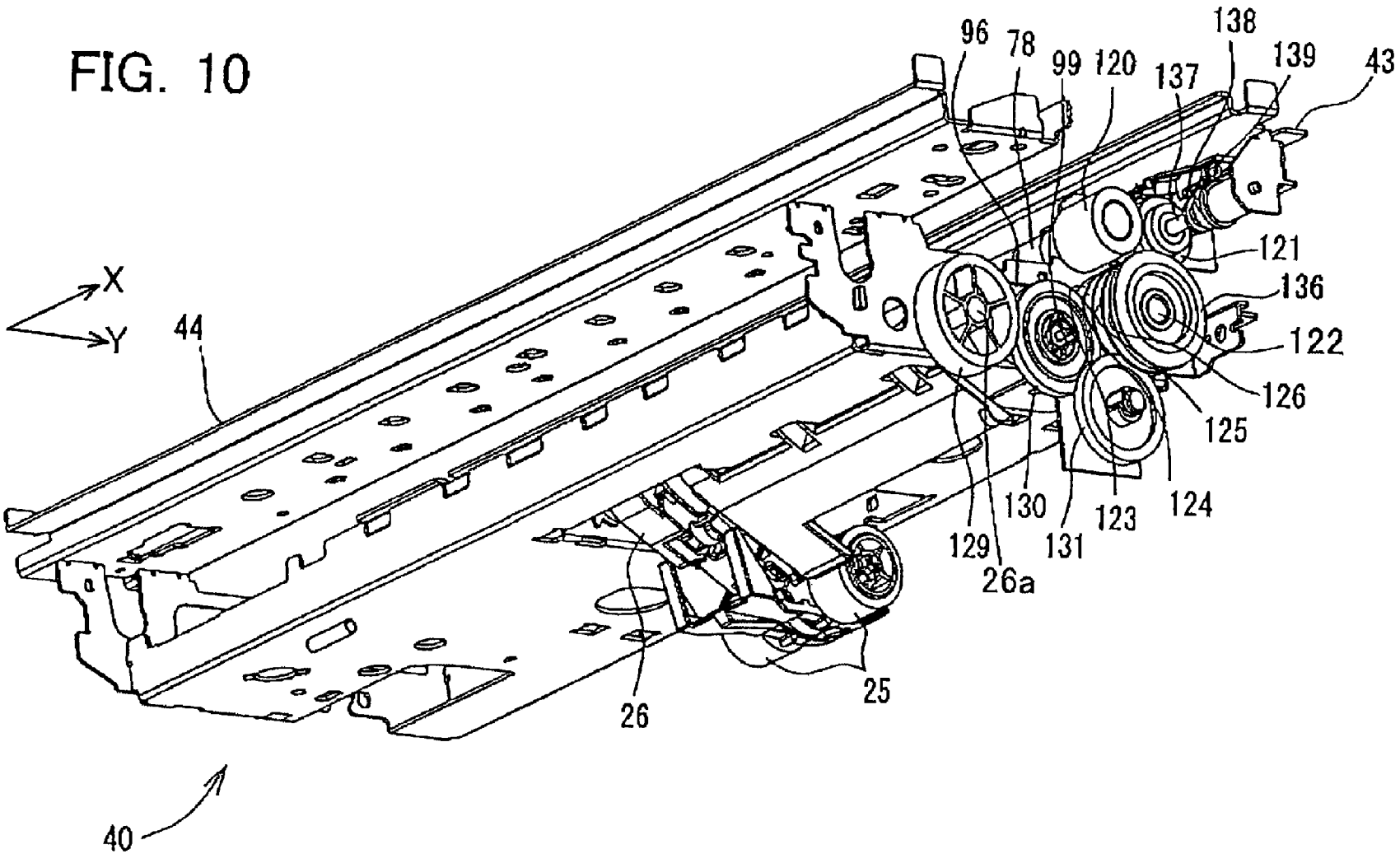
FIG. 10 is a perspective view of first and second mechanisms.

As shown in FIG. 10, the driving force transmitting device 220 is constituted by the conveying roller 78 which is rotated by the LF motor 107, a drive gear 120 placed on the end section of the conveying roller 78, a switch gear 121 for switching the destination for transmitting the driving force of the LF motor 107, a set of driven gears placed on a shaft 122 (a first driven gear 123, second driven gear 124, third driven gear 125, and fourth driven gear 126), a first mechanism, a second mechanism, a third mechanism, and a fourth mechanism. The first mechanism is a mechanism for rotating the first feeding roller 25 in the normal printing mode, and is constituted by a plurality of gears. The second mechanism is a mechanism for rotating the first feeding roller 25 in the high-speed printing mode, and is constituted by a plurality of gears. A third mechanism is a mechanism for rotating the second feeding roller 89 and is constituted by a plurality of gears. The fourth mechanism is a mechanism for activating the purging device 51, and is constituted by a plurality of gears.

It should be noted that teeth of each gear are omitted in FIG. 10. Also, illustration of teeth of each gear is omitted in the figures subsequent to FIG. 10. Moreover, each gear described hereinafter is a spur gear unless otherwise stated.

Although not shown, the LF motor 107 is placed in the vicinity of the end section of the conveying roller 78 (the end section on the far side in FIG. 10). The driving force of the LF motor 107 is transmitted to the conveying roller 78 via a deceleration gear. Therefore, the conveying roller 78 rotates when the LF motor 107 rotates. The drive gear 120 is fixed on other end of the conveying roller 78. As shown in the figure, the width of the drive gear 120 is wider than the switch gear 121 (specifically, the width of the drive gear 120 is comparatively long in the direction parallel to the rotation axis). The drive gear 120 rotates along with the conveying roller 78.

The switch gear 121 is placed adjacent to the drive gear 120. The switch gear 121 is supported rotatably around a shaft 137 which is parallel to the rotation axis of the drive gear 120 (i.e., the conveying roller 78). The switch gear 121 is in engagement with the drive gear 120. The width of the switch gear, 121 is narrower than that of the drive gear 120. The switch gear 121 can slide along a direction parallel to the rotation axis in a state in which the switch gear 121 is in engagement with the drive gear 120. The switch gear 121 can slide within the range of the width of the drive gear 120.

The set of driven gears (the first driven gear 123, second driven gear 124, third driven gear 125, and fourth driven gear 126) are placed obliquely below the drive gear 120. The driven gears 123 through 126 are supported rotatably around the shaft 122 which is parallel to the rotation axis of the drive gear 120. As shown in FIG. 4, the shaft 122 is formed in the purging device 51. It should be noted that the shaft 122 may be provided in the device frame 40.

Figure 14:
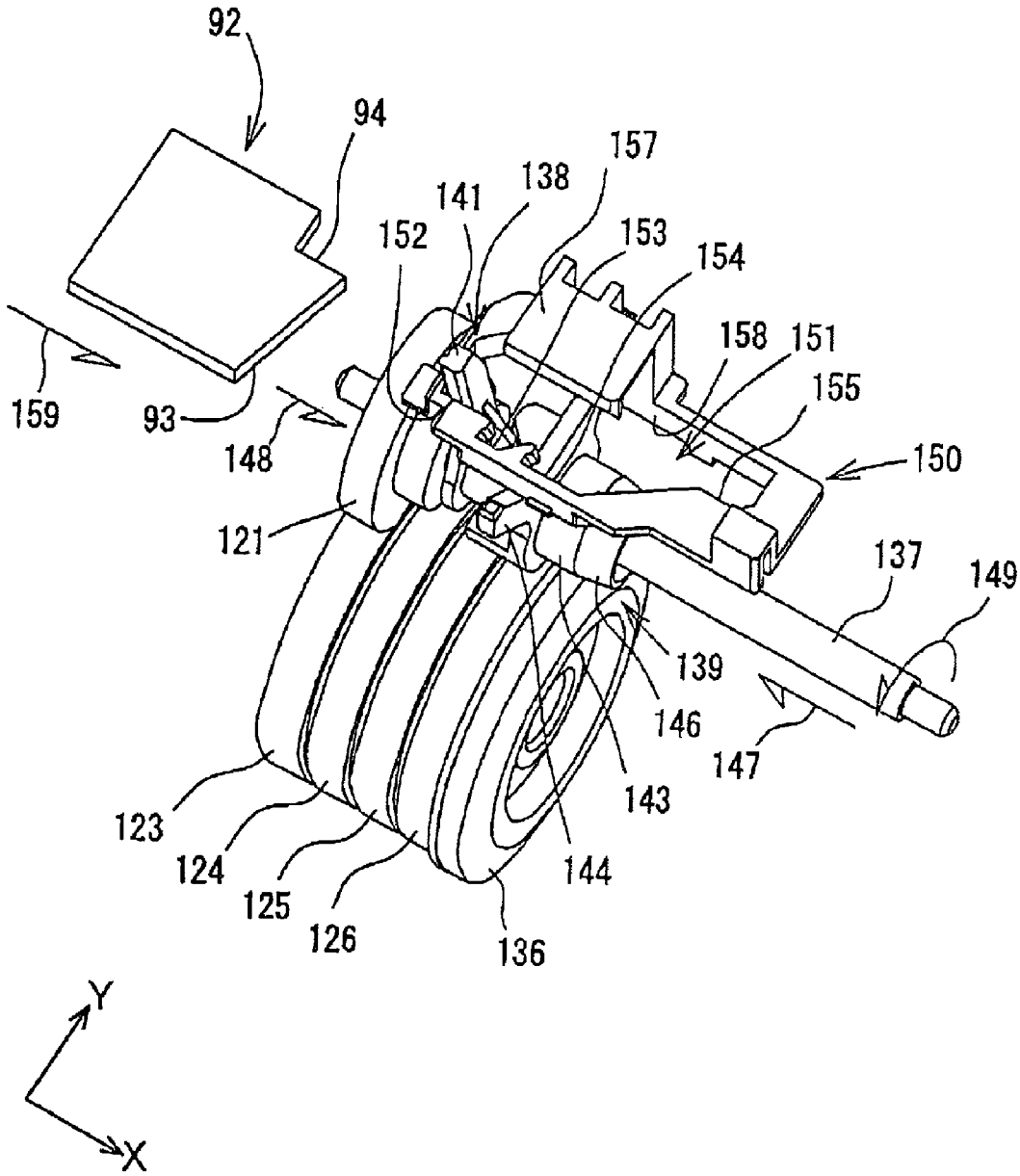
FIG. 14 is a perspective view showing a state in which a switch gear is in engagement with a first driven gear.

As shown in FIG. 14, the driven gears 123 through 126 are arranged in parallel. The driven gears 123 through 126 are spur gears of equal diameter. However, a bevel gear surface 136 is formed on a side face of the fourth driven gear 126 (see FIG. 15). The driven gears 123 through 126 can rotate independently. As described above, the switch gear 121 can slide along a direction parallel to the rotation axis thereof. If the switch gear 121 is positioned in the first position (position shown in FIG. 14), the switch gear 121 will engage with the first driven gear 123. Therefore, when the switch gear 121 is positioned in the first position, the first driven gear 123 is rotated by the rotation of the switch gear 121. When the switch gear 121 is positioned in the second position (position shown in FIG. 16), the switch gear 121 will engage with the second driven gear 124. When the switch gear 121 is positioned in the third position (position shown in FIG. 18), the switch gear 121 will engage with the third driven gear 125. When the switch gear 121 is positioned in the fourth position (position shown in FIG. 20), the switch gear 121 will engage with the fourth driven gear 126. Switch gear 121 engages with different driven gears by sliding between the first position, second position, third position, and fourth position.

Figure 11:
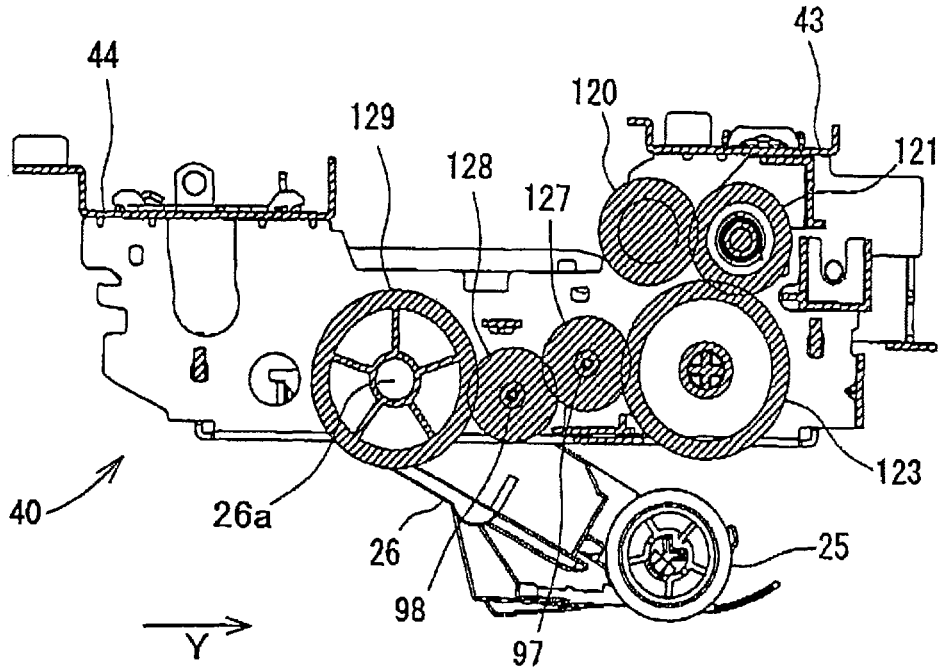
FIG. 11 is a view showing a frame format of the first mechanism.

As shown in FIG. 11, the first mechanism is constituted by gears 127, 128, 129, and a gear group (not shown) arranged inside the first feeding arm 26. The gear 127 is in engagement with the first driven gear 123. The gears 127 and 128 are placed at the back of a supporting member 96 (inside of the device) shown in FIG. 10. The gear 127 is supported by a shaft 97. The gear 128 is supported by a shaft 98. The gear 129 is fixed to one end of the shaft **26*a*. The shaft 26*a* extends in the directions shown in FIG. 10 and functions as a pivot shaft of the first feeding arm 26 (see FIG. 2). One of the gears of the gear group inside the first feeding arm 26 is fixed to other end of the shaft 26*a*. The gear group is arranged tandem from the shaft 26*a* toward the first feeding roller 25**.

When the switch gear 121 rotates at the first position, the first driven gear 123 rotates. When the first driven gear 123 rotates, driving force thereof is transmitted to the gear 129 via the gears 127, 128. Accordingly, the gear 129 rotates. Since the gear 129 is fixed to the shaft **26*a*, the shaft 26*a* rotates when the gear 129 rotates. When the shaft 26*a* rotates, driving force is transmitted to the first feeding roller 25 via the gear group inside the first feeding arm 26. Specifically, the first feeding roller 25** rotates.

Figure 12:
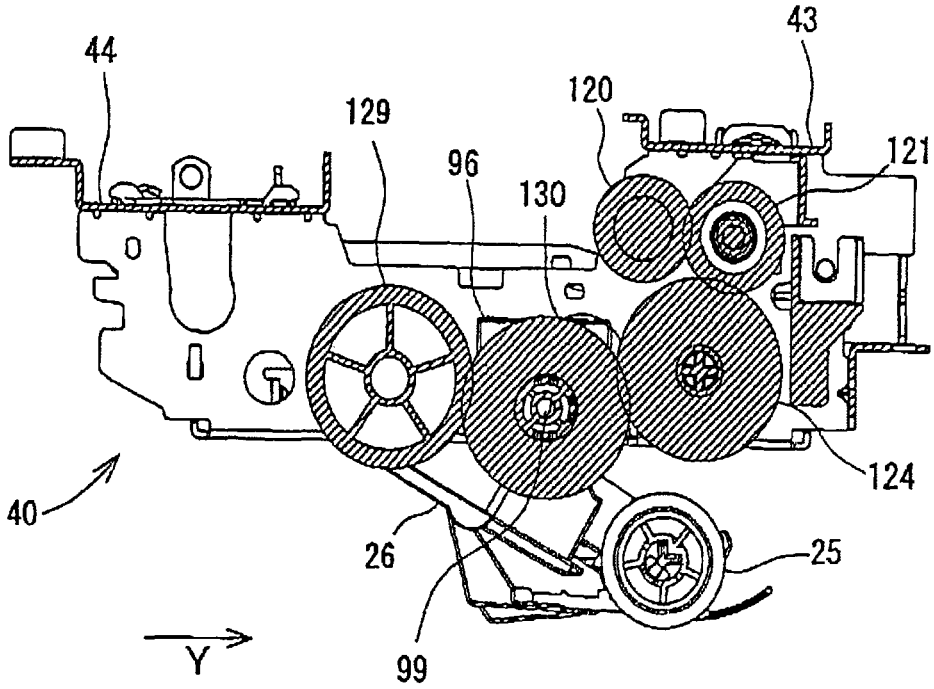
FIG. 12 is a view showing a frame format of the second mechanism.

As shown in FIG. 12, the second mechanism is constituted by gears 130, 129, and the gear group arranged inside the first feeding arm 26. The second driven gear 124 is in engagement with the second mechanism. The gear 130 is placed on the near side of the supporting member 96 (outside of the device) as shown in FIG. 10 The gear 130 is supported by a shaft 99. The gear 129 and the gear group inside the first feeding arm 26 are shared with the first mechanism.

When the switch gear 121 rotates at the second position, the second driven gear 124 rotates. When the second driven gear 124 rotates, driving force thereof is transmitted to the first feeding roller 25 by the gears 130, 129, and the gear group. Accordingly, the first feeding roller 25 rotates.

As described above, both the first mechanism and the second mechanism transmit a driving force to the first feeding roller 25. In the first mechanism, the two gears 127, 128 are placed between the first driven gear 123 and the gear 129. In the second mechanism, only the gear 130 is placed between the second driven gear 124 and the gear 129. Therefore, the direction in which the first feeding roller 25 rotates changes depending upon if the first mechanism or the second mechanism is used.

In the normal printing mode, the driving force is transmitted to the first feeding roller 25 by the first mechanism. In the normal printing mode, the LF motor 107 rotates in the opposite direction. Therefore, the conveying roller 78 rotates in the opposite direction (i.e., the direction opposite to the direction of conveying a paper). On the other hand, when the LF motor 107 rotates in the opposite direction, the first feeding roller 25 to which the driving force is transmitted by the first mechanism rotates in a forward direction (i.e., the direction of conveying a paper). Therefore, the papers are conveyed from the feeding tray 20 to the conveying roller 78 and pinch roller 79. When the conveyed paper makes contact with the conveying roller 78 and pinch roller 79, the paper stops. At this moment, the first feeding roller 25 is in contact with the paper which is being sent, and rotates in aimless circles on the paper. The resist processing is performed by bringing the paper into contact with the conveying roller 78 and pinch roller 79. When the resist processing is ended, the direction of rotation of the LP motor 107 is switched. Specifically, the LF motor 107 rotates in a forward direction (i.e., the direction of conveying the paper). Consequently, the conveying roller 78 rotates in the forward direction. On the other hand, the first feeding roller 25 rotates in the opposite direction. The conveying force of the conveying roller 78 and pinch roller 79 is stronger than that of the first feeding roller 25. Therefore, the paper is conveyed to the printing unit 24 (at this moment, the first feeding roller 25 rotates in aimless circles). When printing a plurality of papers, after the first paper is discharged to the catch tray 21, the LF motor 107 rotates in the opposite direction again. Accordingly, a subsequent paper is sent from the feeding tray 20.

In the high-speed printing mode, the driving force is transmitted to the first feeding roller 25 by the second mechanism. In the high-speed printing mode, the LF motor 107 rotates in the forward direction. Moreover, the first feeding roller 25 to which the driving force is transmitted by the second mechanism also rotates in the forward direction. Therefore, a paper is conveyed from the feeding tray 20 to the conveying roller 78 and pinch roller 79. The conveyed paper is conveyed to the printing unit 24 by the conveying roller 78 and pinch roller 79. Specifically, the paper does not stop at the conveying roller 78 and pinch roller 79. Therefore, the resist processing is not performed. Moreover, the paper conveying speed of the conveying roller 78 and pinch roller 79 is faster than that of the first feeding roller 25. Therefore, when the paper is held between the conveying roller 78 and the pinch roller 79, the first feeding roller 25 rotates in aimless circles. Furthermore, when the paper is completely sent out from the feeding tray 20, the first feeding roller 25 makes contact with a subsequent sheet of paper. Therefore, the subsequent sheet of paper is sent by the first feeding roller 25. Specifically, once the previous sheet of paper is sent, the subsequent sheet of paper is sent from the feeding tray 20. As described above, the paper conveying speed of the conveying roller 78 and pinch roller 79 is faster than that of the first feeding roller 25. Therefore, a predetermined gap is formed between the previous sheet of paper and the subsequent sheet of paper. Therefore, the papers are prevented from being sent in an, overlapped state.

Figure 13:
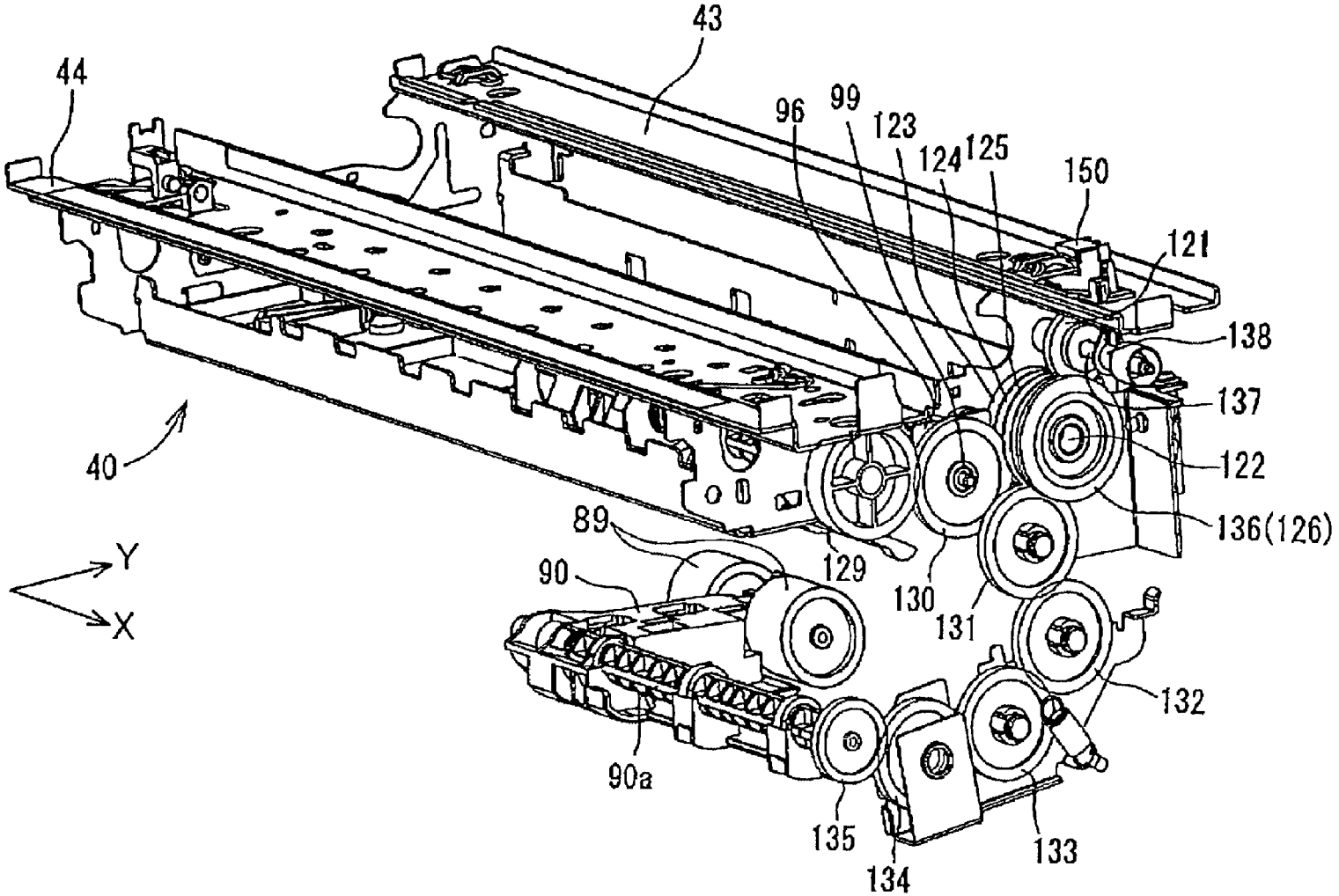
FIG. 13 is a perspective view of a third mechanism.

As shown in FIG. 13, the third mechanism is constituted by gears 131 through 135 and a gear group (not shown) arranged inside the second feeding arm 90. The gear 131 is in engagement with the third driven gear 125. The gear 135 is fixed to one end of the shaft 90*a*. The shaft 90*a* extends in the X direction as shown in FIG. 13 and functions as a pivot shaft for the second feeding arm 90 (see FIG. 2). One of the gears in the gear group inside the second feeding arm 90 is fixed to other end of the shaft 90*a*. The gear group is arranged in tandem from the shaft 90*a* toward the second feeding roller 89.

When the switch gear 121 rotates at the third position, the third driven gear 125 rotates. When the third driven gear 125 rotates, driving force is transmitted to the gear 135 via the gears 131 through 134. Accordingly, the gear 135 rotates. Since the gear 135 is fixed to the shaft 90*a*, the shaft 90*a* also rotates. When the shaft 90*a* rotates, driving force is transmitted via the gear group, and thereby the second feeding roller 89 rotates. Accordingly, the paper in the feeding tray 11 are conveyed. It should be noted that printing the paper stored in the feeding tray 11 is performed in the normal printing mode.

The fourth mechanism is constituted by the bevel gear 62 of the purging device 51 (see FIG. 4), and the pump gear of the pump 54. The bevel gear 62 is in engagement with the bevel gear surface 136 of the fourth driven gear 126. Further, the bevel gear 62 is in engagement with the pump gear of the pump 54.

When the switch gear 121 rotates at the fourth position, the fourth driven gear 126 rotates. Consequently, the bevel gear 62 rotates and the pump gear rotates. When the pump gear rotates, the pump performs drawing. Specifically, the purging device is activated.

It should be noted that the fourth mechanism transmits a larger driving force, as compared to the first through third mechanisms (i.e., the fourth driven gear 126 transmits a larger driving force, as compared to the driven gears 123 through 125). Furthermore, the driving force may be transmitted from the fourth driven gear 126 to the port switching device 59 to perform switching of the inlet passages.

As described above, the switch gear 121 slides, and then the switch gear is selects a driven gear to engage with, whereby the operation executed by the printer 2 is determined.

<Structure for Sliding the Switch Gear 121>

Figure 15:
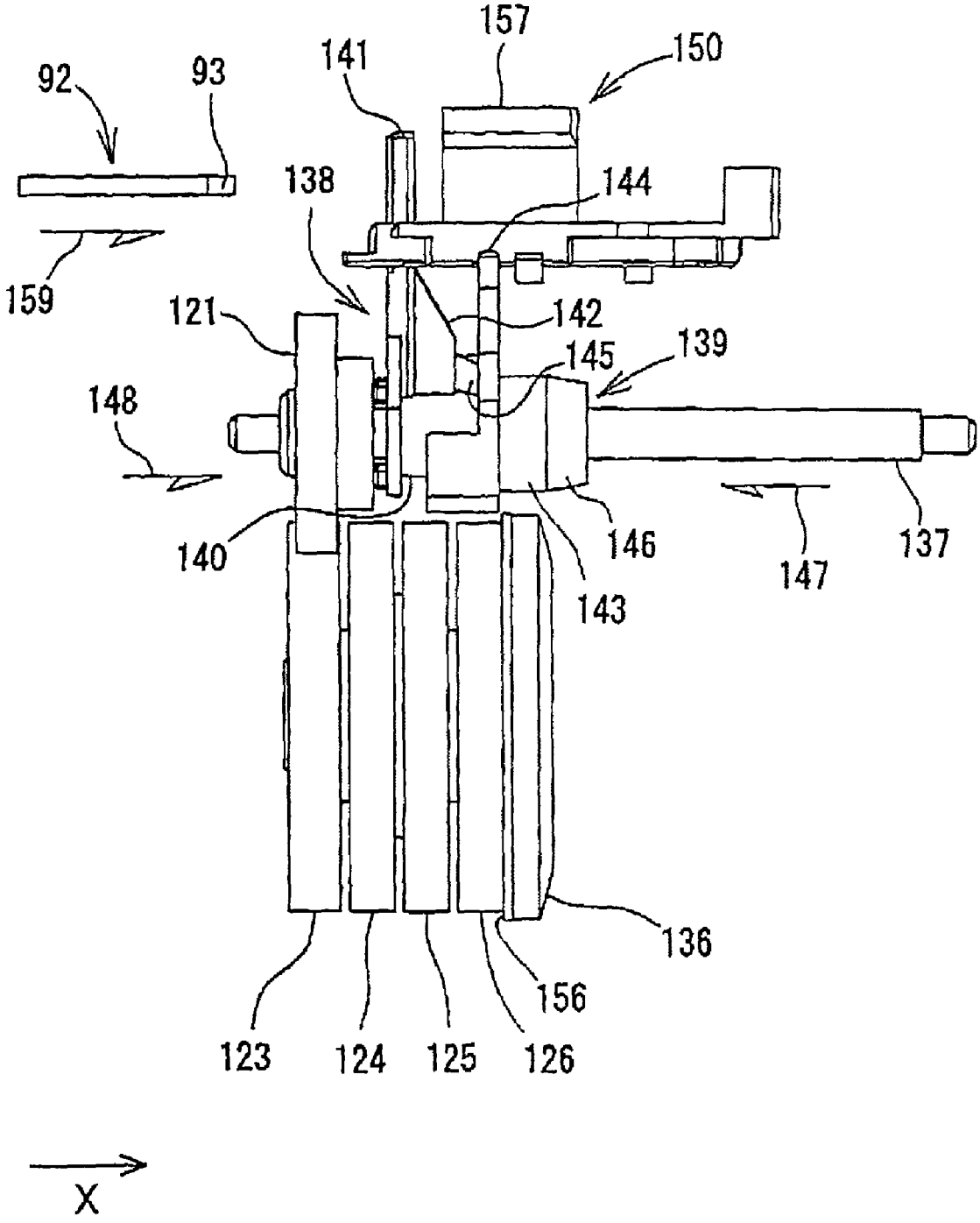
FIG. 15 is a front view showing the state in which the switch gear is in engagement with the first driven gear.

Next, the structure for sliding the switch gear 121 is explained. As shown in FIGS. 14 and 15, a lever member 138 and a fixing member 139 are placed on the shaft 137. A lever guide 150 is placed in the upper section of the lever member 138 and the fixing member 139.

As shown in FIG. 3, the guide member 92 is placed in the carriage 38. Therefore, the guide member 92 is moved by movement of the carriage 38. The guide member 92 moves along a direction of an arrow 159 shown in FIG. 14. An inclined surface 93 and a cut-out section 94 are formed on one end section of the guide member 92. When the guide member 92 moves along the direction of the arrow 159, the inclined surface 93 is brought into contact with a lever 141.

As shown in FIGS. 14, 15, the lever guide 150 is placed in the upper section of the shaft 137. The lever guide 150 is attached to a mounting hole 91 formed on a guide rail 43 shown in FIG. 3 (the lever guide 150 is omitted in FIG. 3). The lever guide 150 is a plate-like member. A guide hole 151 is formed on the lever guide 150. A first guide shape 152, second guide shape 153, third guide shape 154, and fourth guide shape 155 are formed on the guide hole 151. A return guide 157 is formed on the opposite side of the second guide shape 153 and the third guide shape 154 of the guide hole 151 (an edge section 158 shown in FIG. 14).

Figure 22:
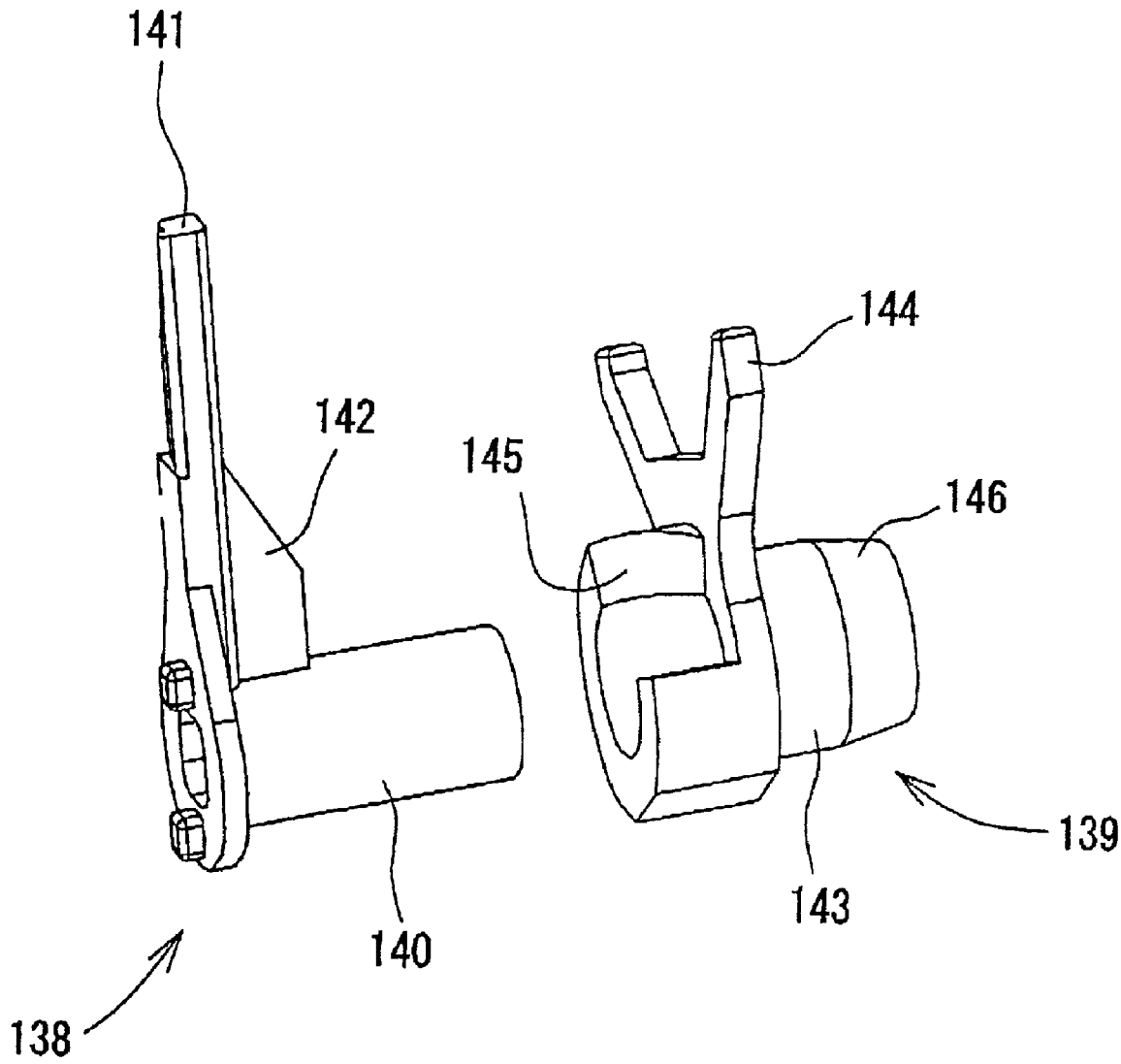
FIG. 22 is a perspective view of a lever member and a fixing member.

FIG. 22 shows a perspective view of the lever member 138 and fixing member 139. As shown in FIG. 22, the lever member 138 has a cylinder 140 and a lever 141 protruding from the cylinder 140. A rib 142 is formed on a base end of the lever 141. As shown in FIGS. 14, 15, the shaft 137 is inserted into the cylinder 140. Accordingly, the lever 138 can slide with respect to the shaft 137. Specifically, the lever member 138 can rotate with respect to the shaft 137 and slide along the direction in which the shaft 137 extends. Moreover, the lever 141 of the lever member 138 is inserted into the guide hole 151 of the lever guide 150.

As shown in FIG. 22, the fixing member 139 has a cylinder 143 and a slide guide 144 protruding from the cylinder 143. The inner diameter of the cylinder 143 is larger, on the lever member 138 side, than the outer diameter of the cylinder 140 of the lever member 138. Furthermore, at the end section 146 of the cylinder 143, the inner diameter is smaller than the outer diameter of the cylinder 140 of the lever member 138. A section of the end section on the lever member 138 side of the cylinder 143 is cut out (a cut-out section 145), this section corresponds with the slide guide 144. As shown in FIGS. 14, 15, the cylinder 140 of the lever member 138 is inserted into the cylinder 143. Accordingly, the fixing member 139 can slide with respect to the lever member 138. The lever member 138 is inserted into the fixing member 139 such that the rib 142 is positioned on the cut-out section 145 of the fixing member 139. Moreover, a distal end of the slide guide 144 is split into two parts, and the lever guide 150 is fitted between the two parts. Accordingly, the fixing member 139 is prevented from rotating around the shaft 137.

The fixing member 139 is biased to the lever member 138 side (a direction of an arrow 147 shown in FIG. 14) by a spring which is not shown. Furthermore, the switch gear 121 is biased to the lever member 138 side (a direction of an arrow 148 shown in FIG. 14) by another spring which is not shown. The force that biases the fixing member 139 is stronger than the force that biases the switch gear 121. Moreover, when the fixing member 139 is biased to the lever member 138 side, a force acts from the cut-out section 145 onto the rib 142. This force attempts to rotate the lever 141 in the direction of the arrow 149 shown in FIG. 14.

FIGS. 14, 15 show a state in which the switch gear 121 is in engagement with the first driven gear 123. In such a state, the lever 141 of the lever member 138 is brought into contact with the left edge within the guide hole 151 (the position of the first guide shape 152 shown in FIG. 14) by the biasing force of the, fixing member 139 (the force indicated by the arrow 147) and the force applied to the rib 142 (the force indicated by the arrow 149). Accordingly, the position of the lever member 138 is fixed. Moreover, since the switch gear 121 is biased to the lever member 138 side, the position of the switch gear 121 is also fixed. Therefore, the condition in which the switch gear 121 is in engagement with the first driven gear 123 is maintained. In such a state, the driving force is transmitted to the first mechanism.

Figure 16:
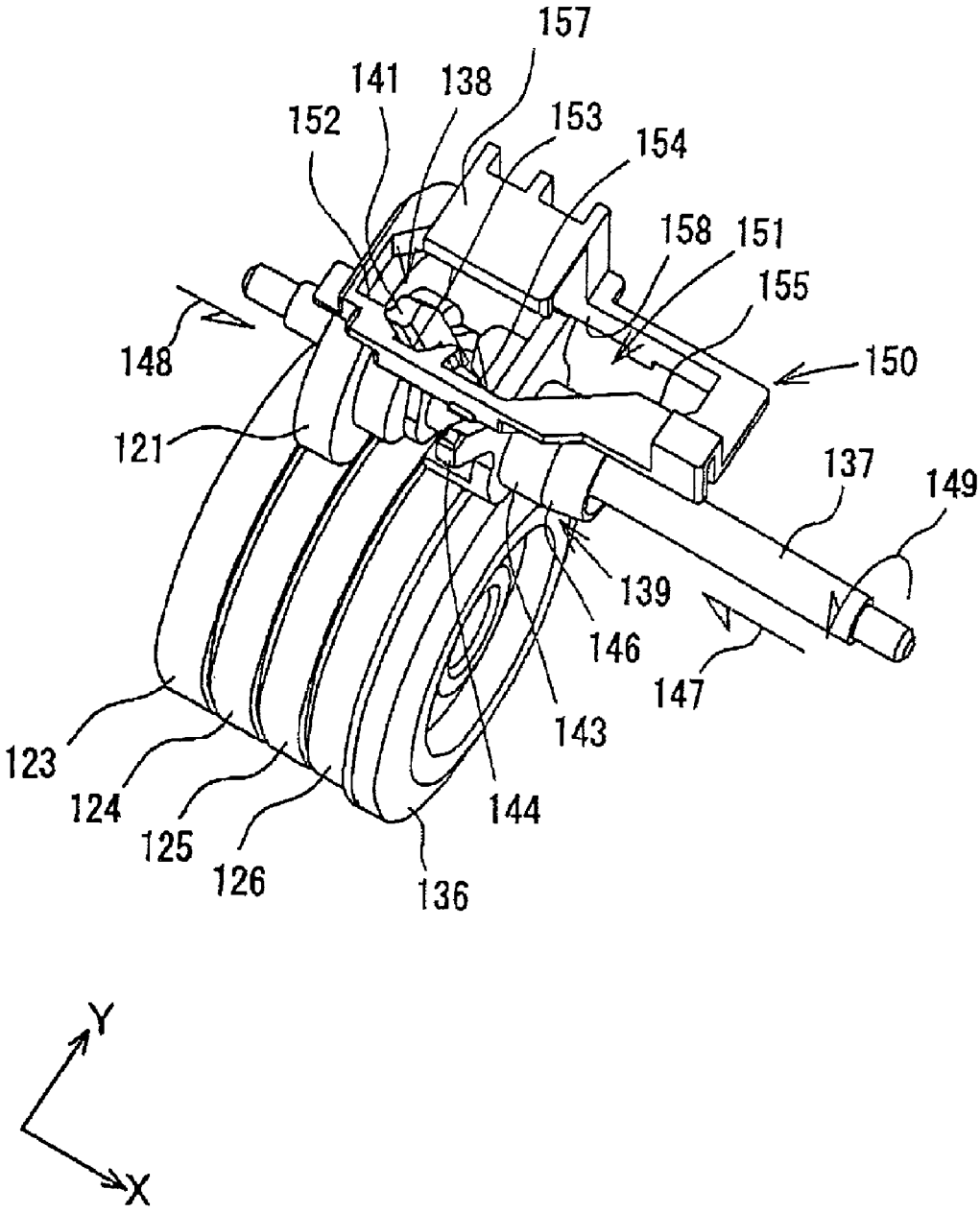
FIG. 16 is a perspective view showing a state in which the switch gear is in engagement with a second driven gear.
Figure 17:
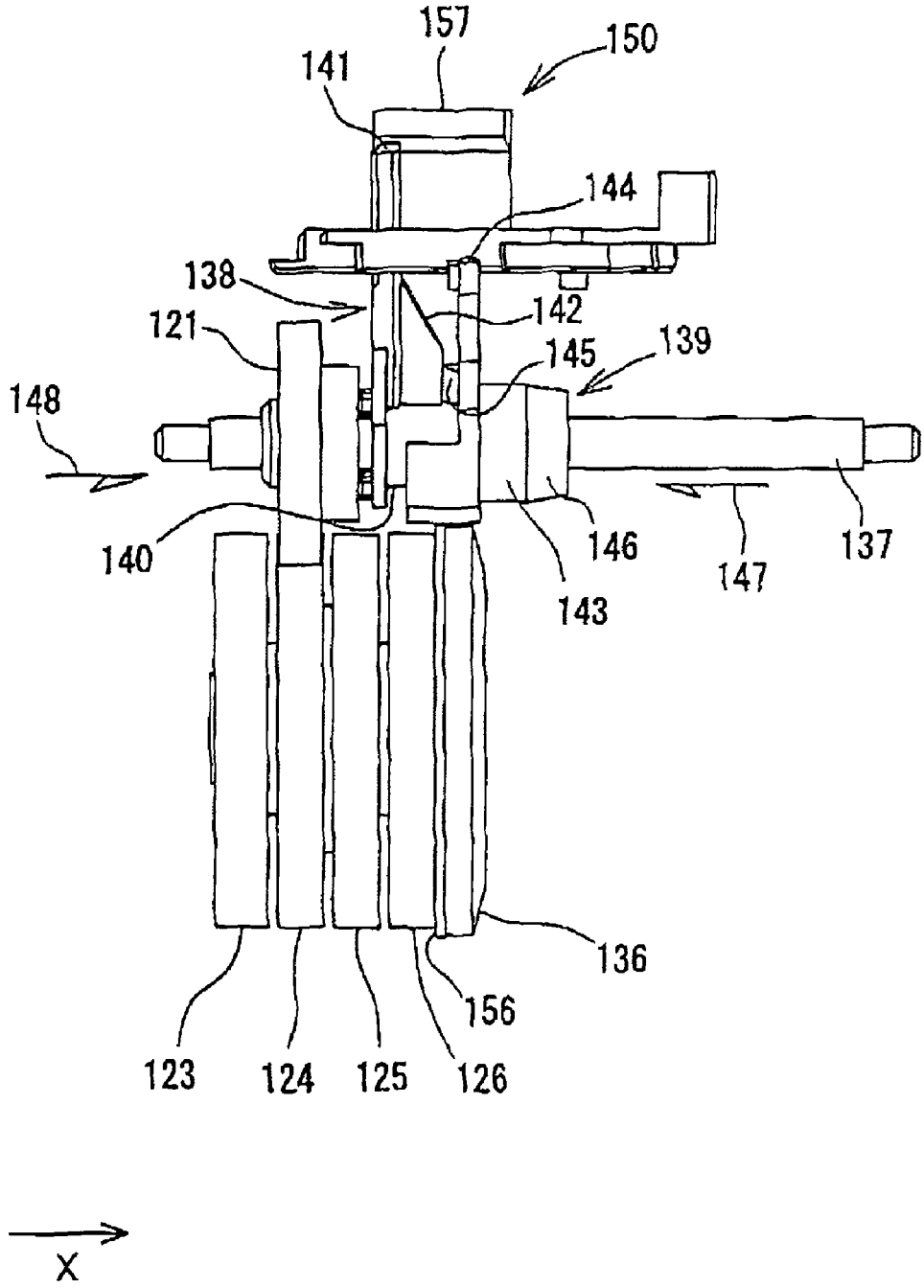
FIG. 17 is a front view showing the state in which the switch gear is in engagement with the second driven gear.

When the guide member 92 moves along the direction of the arrow 159 and the inclined surface 93 of the guide member 92 makes contact with the lever 141, the lever 141 is pressed by the guide member 92 and moves along the direction of the arrow 159. As shown in the figure, the inclined surface 93 is inclined toward the lever 141. Therefore, while the lever 141 is pressed against the inclined surface 93, a force in the direction indicated by the arrow 149 acts from the inclined surface 93 onto the lever 141. Moreover, as described above, the force in the direction indicated by the arrow 149 also acts on the rib 142 of the lever 141. If the lever 141 is pressed by the guide member 92 by a predetermined distance, the lever 141 is moved into the second guide shape 153 by the force indicated by the arrow 149 (see FIGS. 16, 17). If the guide member 92 returns to its original position after the lever 141 moves into the second guide shape 153 (i.e., if the guide member 92 moves in the opposite direction from the direction of the arrow 159), the lever 141 is supported by the second guide shape 153. Specifically, the lever 138 and fixing member 139 stop at the positions shown in FIGS. 16, 17. Furthermore, the switch gear 121 is biased in the direction of the lever member 138 (the direction of the arrow 148). Therefore, the switch gear 121 slides when the lever 138 moves. When the lever 141 is supported by the second guide shape 153, it causes the switch gear 121 to engage with the second driven gear 124 as shown in FIGS. 16, 17. In such a state, the driving force is transmitted to the second mechanism.

Figure 18:
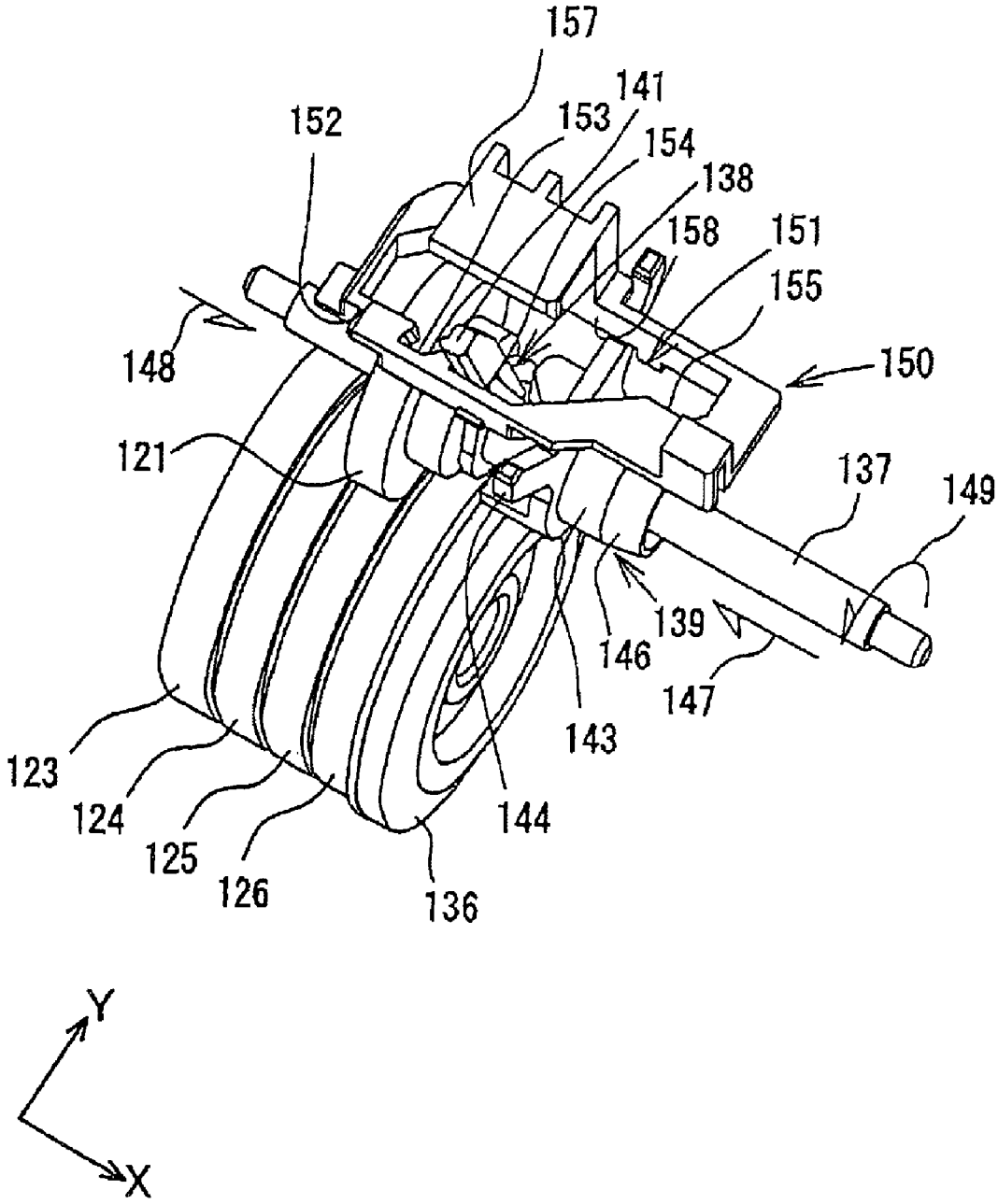
FIG. 18 is a perspective view showing a state in which the switch gear is in engagement with a third driven gear.
Figure 19:
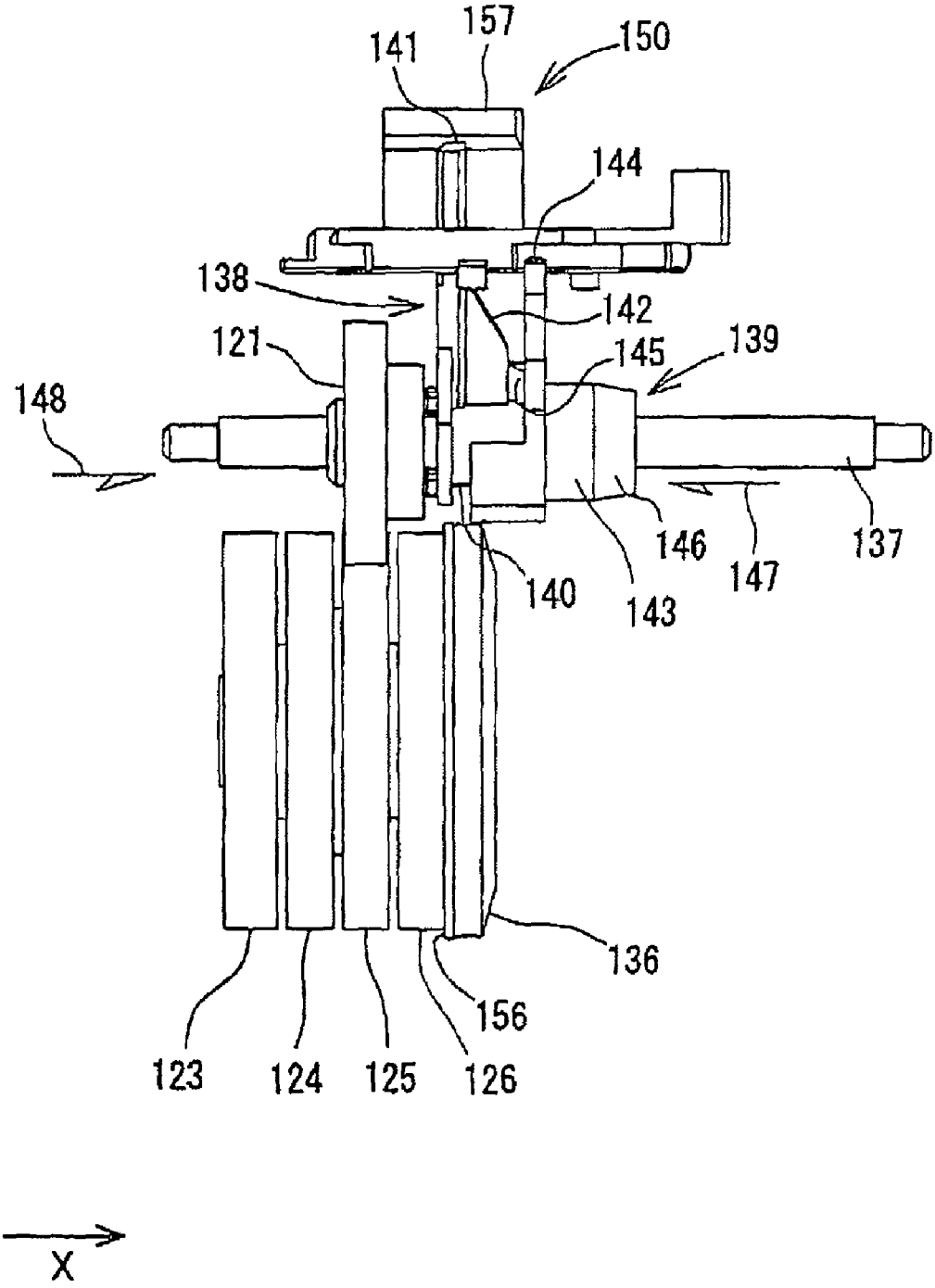
FIG. 19 is a front view showing the state in which the switch gear is in engagement with the third driven gear.

When the guide member 92 further moves the lever 141 in the direction of the arrow 159 by a predetermined amount, the lever 141 is moved into the third guide shape 154 (see FIGS. 18, 19). If the guide member 92 returns to its original position after the lover 141 moves into the third guide shape 154, the lever 141 is supported by the third guide shape 154. Specifically, the lever 138 and fixing member 139 stop at the positions shown in FIGS. 18, 19. Furthermore, when the lever 141 is supported by the third guide shape 154, it causes the switch gear 121 to engage with the third driven gear 125 as shown in FIGS. 18, 19. In such a state, the driving force is transmitted to the third mechanism.

Figure 20:
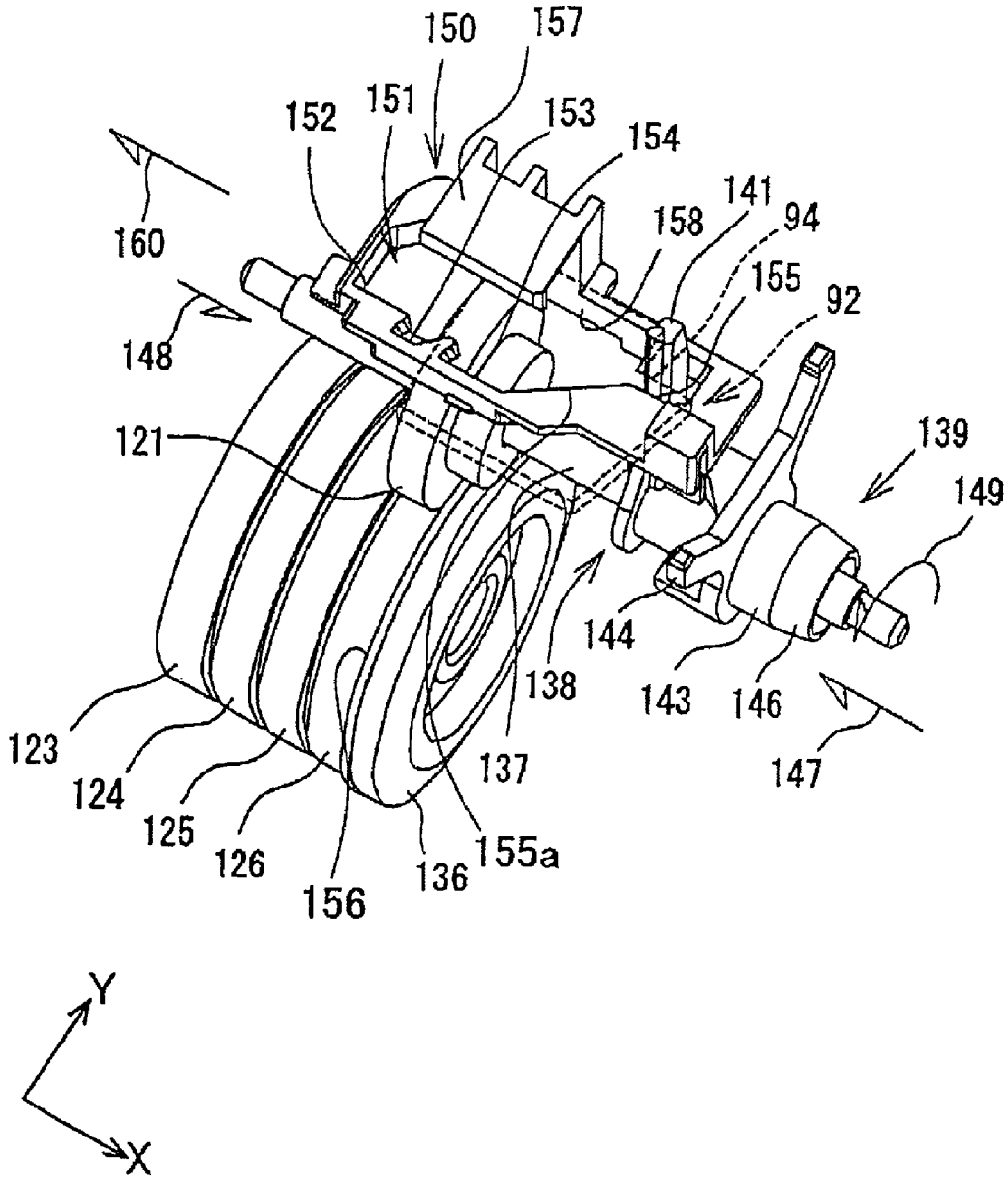
FIG. 20 is a perspective view showing a state in which the switch gear is in engagement with a fourth driven gear.
Figure 21:
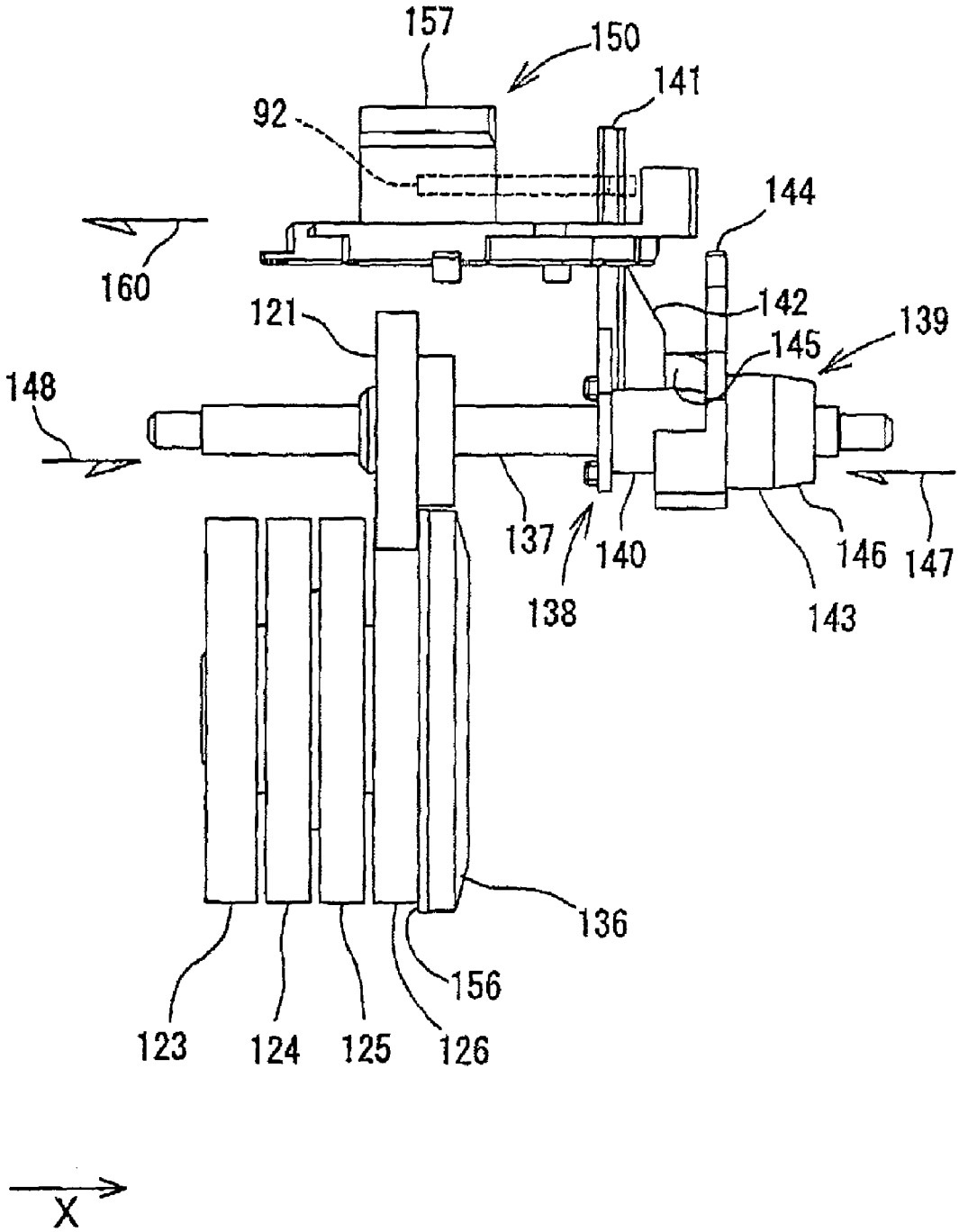
FIG. 21 is a front view showing the state in which the switch gear is in engagement with the fourth driven gear.

When the guide member 92 moves the lever 141 toward the fourth guide shape 155 side, the lever 141 slides along with a guide shape 155*a* of the guide hole 151. At this moment, as a result of being guided by the guide shape 155*a*, the lever 141 slightly rotates in a direction opposite the direction of the arrow 149. Accordingly, this causes the lever 141 to engage with the cut-out section 94 of the guide member 92. Then, the lever 141 moves into the fourth guide shape 155 as shown in FIGS. 20, 21. When the lever 141 is positioned at the fourth guide shape 155, the lever 141 is supported by the cut-out section 94 of the guide member 92, whereby the position of the lever 141 is fixed. When the lever 141 is fixed in the fourth guide shape 155, the lever member 138 and fixing member 139 stop at the positions shown in FIGS. 20, 21. Furthermore, the switch gear 121 is slid along with the lever member 138 by a biasing force (force indicated by the arrow 148), and, while moving, brought into contact with a restricting surface 156 formed on the fourth driven gear 126. Accordingly, this causes the switch gear 121 to engage with the fourth driven gear 126. Moreover, since the lever 138 is further moved along the direction of the arrow 148, the fourth driven gear 126 is separated from the lever member 138 (FIGS. 20, 21). In such a state, the driving force is transmitted to the fourth mechanism.

If the guide member 92 moves in a direction of an arrow 160 from the state shown in FIG. 20, the lever 141 is moved in the direction of the arrow 147 by the biasing force (the force indicated by the arrow 147). Specifically, the lever member 138 and fixing member 139 move along the direction of the arrow 147. Consequently, the lever 138 makes contact with the switch gear 121, and the switch gear 121 also slides along in the direction of the arrow 147. The lever 141 is brought into contact with the return guide 157 while, moving, and then separates from the guide member 92. Thereafter, the lever 141 is guided by the return guide 157 to the first guide shape 152. Accordingly, the lever member 138, fixing member 139 and switch gear 121 move to the positions shown in FIGS. 14, 15.

As described above, the guide member 92 placed in the carriage 38 moves the position of the lever 141. Accordingly, the position of the switch gear 121 is changed. Specifically, the gear that switch gear 121 engages with is switched between the driven gears 123 through 126. Specifically, the transmission destination to which the driving force transmitting device 220 transmits the driving force is switched.

<Structures of the Driven Gears 123 Through 126>

Figure 23:
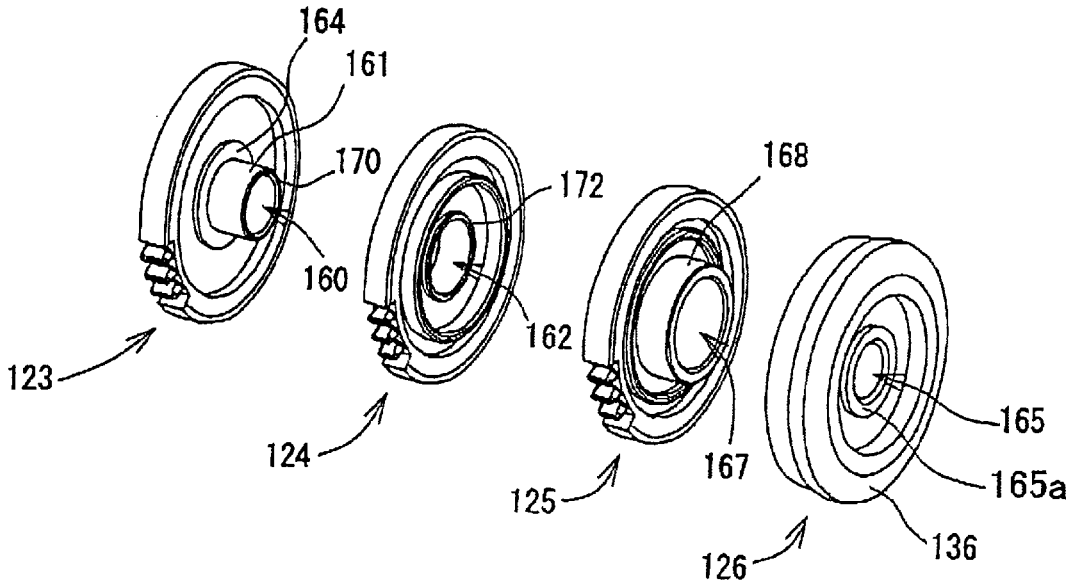
FIG. 23 is a perspective view showing a set of driven gears.
Figure 24:
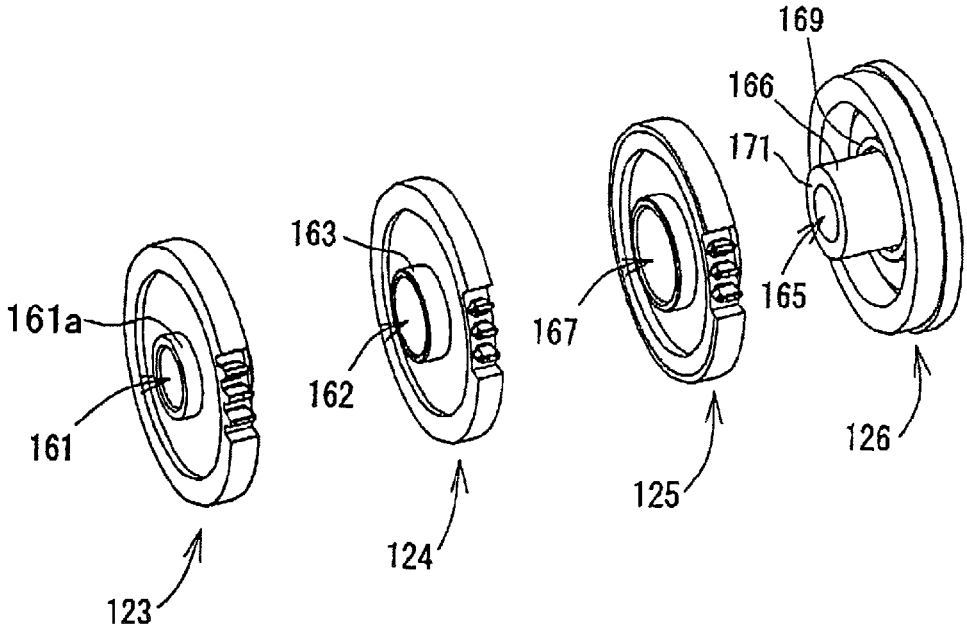
FIG. 24 is a perspective view showing the set of driven gears.
Figure 25:
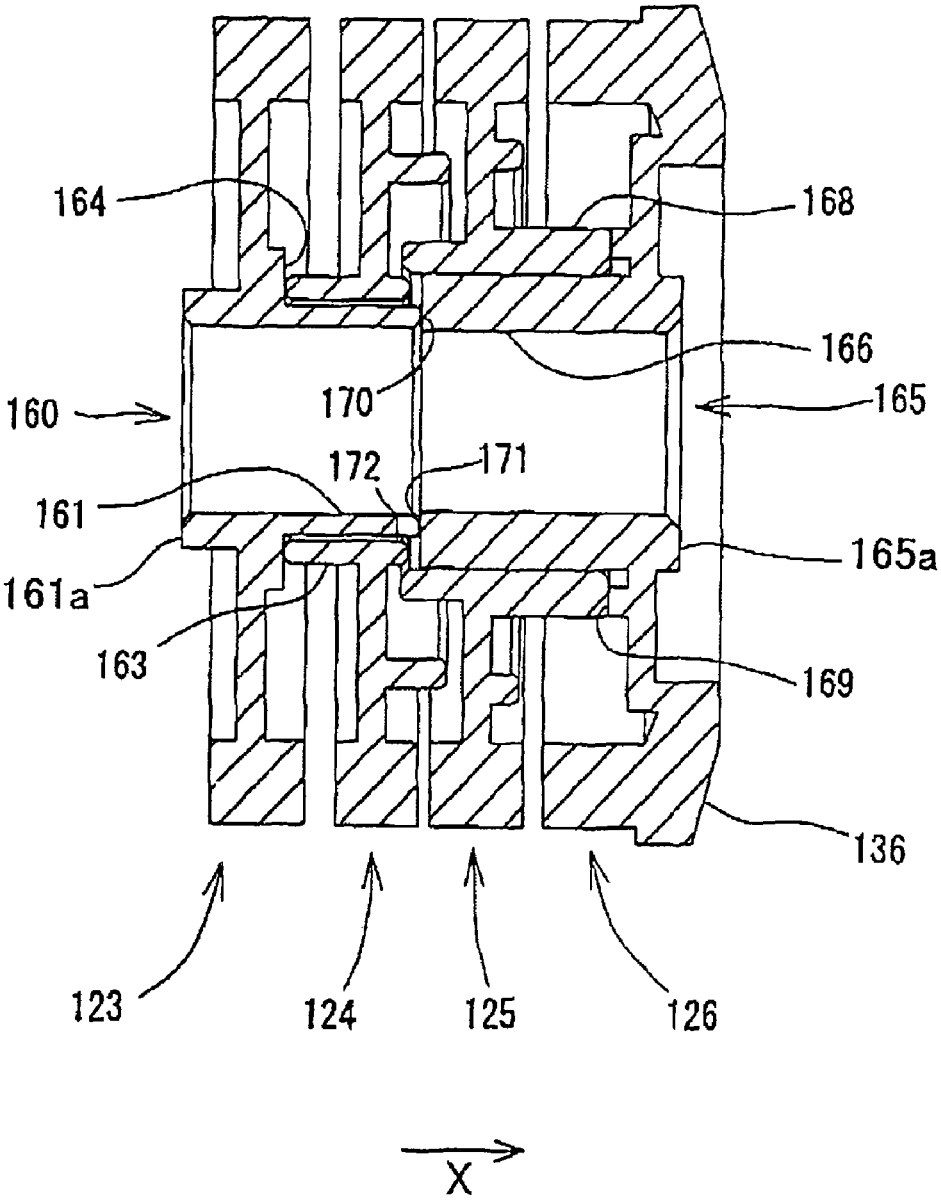
FIG. 25 is a cross-sectional view showing a setting structure of the set of driven gears of the complex machine.

The structures of the driven gears 123 through 126 are described next. The driven gears 123 through 126 are pinion gears. FIG. 23 and FIG. 24 are perspective views showing the driven gears 123 through 126. Also, FIG. 25 shows a cross-sectional view of a state in which the set of driven gears (driven gears 123 through 126) are placed.

A shaft hole 160 is formed on the first driven gear 123. The shaft 122 (illustration thereof is omitted in FIG. 23 through FIG. 25. See FIG. 10) is inserted into the shaft hole 160. The first driven gear 123 can rotate around the shaft 122. On a side face of the first driven gear 123, on the same side as the second driven gear 124, there is a cylinder 161 protruding from the side face. The cylinder 161 is formed around the axis hole 160 so as to be concentric with the axis hole 160. A contact surface 164 is formed on a side face on a periphery of the cylinder 161. Moreover, on other side face of the first driven gear 123, there is a cylinder 161*a* protruding from the side face. An end surface of the cylinder 161*a* is in contact with a member which is not shown.

A shaft hole 165 is formed on the fourth driven gear 126. The shaft 122 is inserted into the shaft hole 165. The fourth driven gear 126 can rotate around the shaft 122. On a side face of the fourth driven gear 126, on the same side as the third driven gear 125, there is a cylinder 166 protruding from the side face. The cylinder 166 is formed around the shaft hole 165 so as to be concentric with the shaft hole 165. The diameter of the cylinder 166 is larger than the diameter of the cylinder 161 of the first driven gear 123. As shown in FIG. 25, an end surface 171 of the cylinder 166 is in contact with an end surface 170 of the cylinder 161 of the first driven gear 123. Moreover, a contact surface 169 is formed on a side face on a periphery of the cylinder 166. Also, on other side face of the fourth driven gear 126, there is a cylinder 165*a* protruding from the side face. An end surface of the cylinder 165*a* is in contact with a member which is not shown.

As described above, the end surface of the cylinder 165*a* is in contact with the unshown member, the end surface 171 of the cylinder 166 is in contact with the end surface 170 of the cylinder 161 of the first driven gear 123, and the end surface of the cylinder 161*a* of the first driven gear 123 is in contact with the unshown member. Accordingly, the position in the direction parallel to the rotation axis of the first driven gear 123 and fourth driven gear (the position in the X direction shown in FIG. 26, which is referred to as "axial direction" hereinafter), and the position in the axial direction of the fourth driven gear 126 are fixed.

A shaft hole 162 is formed in the center of the second driven gear 124. The diameter of the shaft hole 162 is larger than the diameter of an outer periphery of the cylinder 161 of the first driven gear 123 by a predetermined amount. As shown in FIG. 25, the cylinder 161 of the first driven gear 123 is inserted into the shaft hole 162. Specifically, the second driven gear 124 is placed so as to be able to rotate around the cylinder 161. On a side face of the second driven gear 124, on the same side as the first driven gear 123, there is a cylinder 163 protruding from the side face. The cylinder 163 is formed around the shaft hole 162 so as to be concentric with the shaft hole 162. Furthermore, on a side face of the second driven gear 124, on the same side as the third driven gear 125, there is a cylinder 172 protruding from the side face. The cylinder 172 is formed around the shaft hole 162 so as to be concentric with the shaft hole 162. As shown in FIG. 25, the second driven gear 124 is placed such that the cylinders 163, 172 are positioned between the contact surface 164 of the first driven gear 123 and the end surface 171 of the cylinder 166 of the fourth driven gear 126. Accordingly, the position of the second driven gear 124 in the axial direction is fixed.

A shaft hole 167 is formed in the center of the third driven gear 125. The diameter of the shaft hole 167 is larger than the diameter of an outer periphery of the cylinder 166 of the fourth driven gear 126 by a predetermined amount. As shown in FIG. 25, the cylinder 166 is inserted into the shaft hole 167. Accordingly, the third driven gear 125 is supported so as to be able to rotate around the cylinder 166. On a side face of the third driven gear 125, on the same side as the fourth driven gear 126, there is formed a cylinder 168 protruding from the side face. The cylinder 168 is formed around the shaft hole 167 so as to be concentric with the shaft hole 167. As shown in FIG. 25, the third driven gear 125 is placed between the fourth driven gear 126 and the second driven gear 124. Accordingly the position of the third driven gear 125 in the axial direction is fixed.

<Structure of Driven Gears of a Low-Level Type of the Complex Machine 1>

As described above, the complex machine 1 is the highest level machine type in the series. Therefore, there exists a complex machine which is of a lower level than that of the complex machine 1. A complex machine 1*a*, which is lower than the complex machine 1 by one grade, has a normal printing function, high-speed printing function and purging operation function, but does not have the feeding tray 11. Also, a complex machine 1*b*, which is a lower grade than that of the complex machine 1*a*, has the normal printing function and purging operation function, but has neither the high-speed printing function nor feeding tray 11. The structures of the complex machines 1*a* and 1*b* are very similar to that of the complex machine 1 except for the abovementioned differences. The structures of driven gears of the complex machines 1*a*, 1*b* are described hereinafter.

Figure 26:
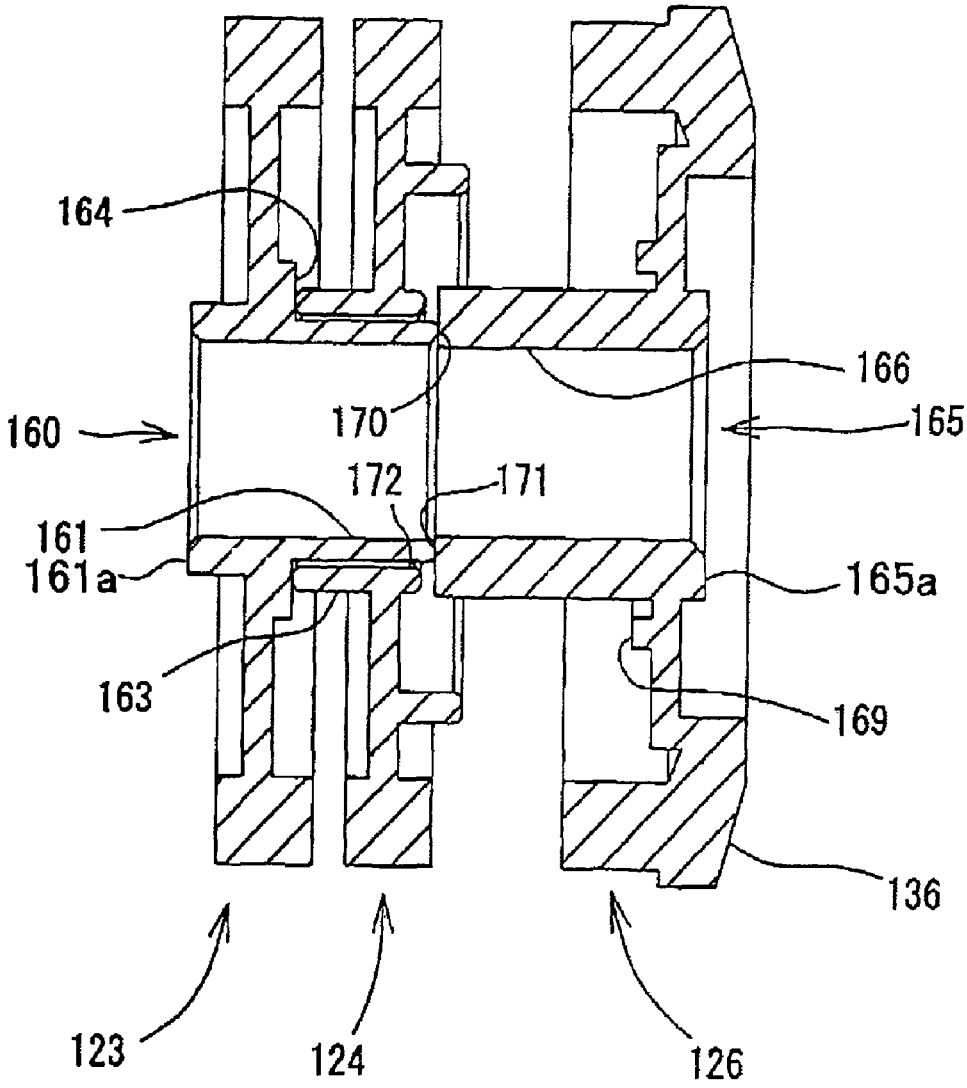
FIG. 26 is a cross-sectional view showing a setting structure of the set of driven gears of a complex machine of an additional embodiment.
Figure 27:
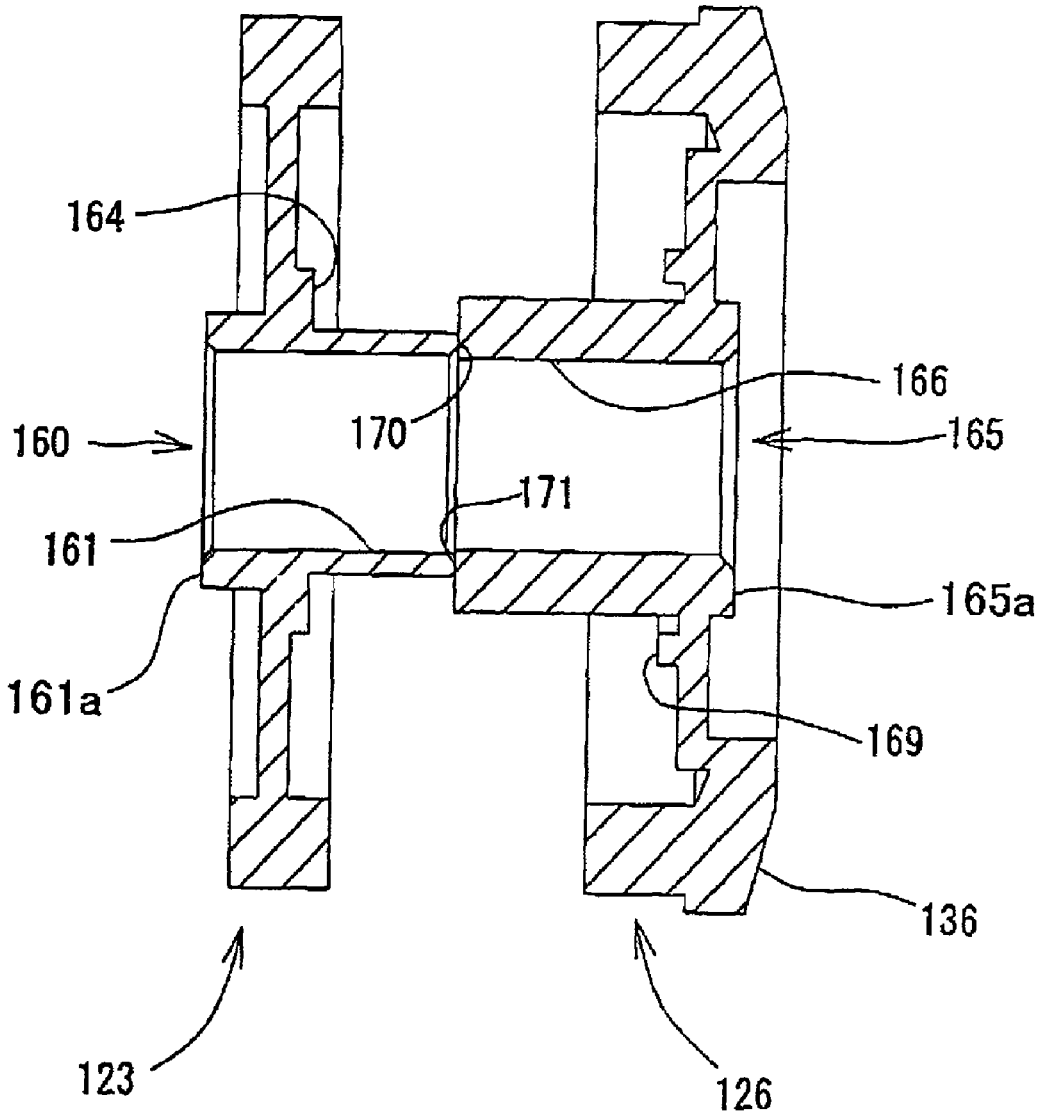
FIG. 27 is a cross-sectional view showing a setting structure of the set of driven gears of a complex machine of another additional embodiment.
Figure 28A:
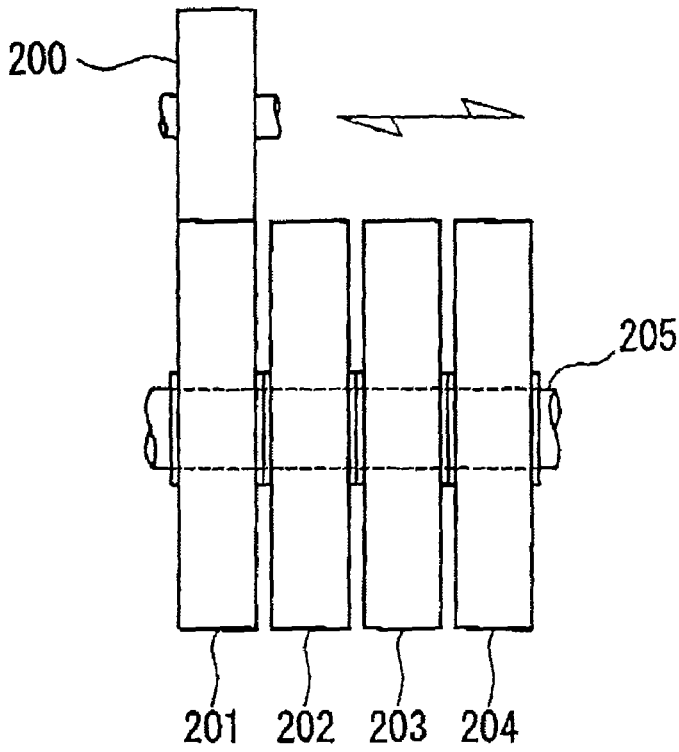
FIG. 28A and FIG. 28B are figures showing a setting structure of a set of driven gears of a conventional printer.
Figure 28B:
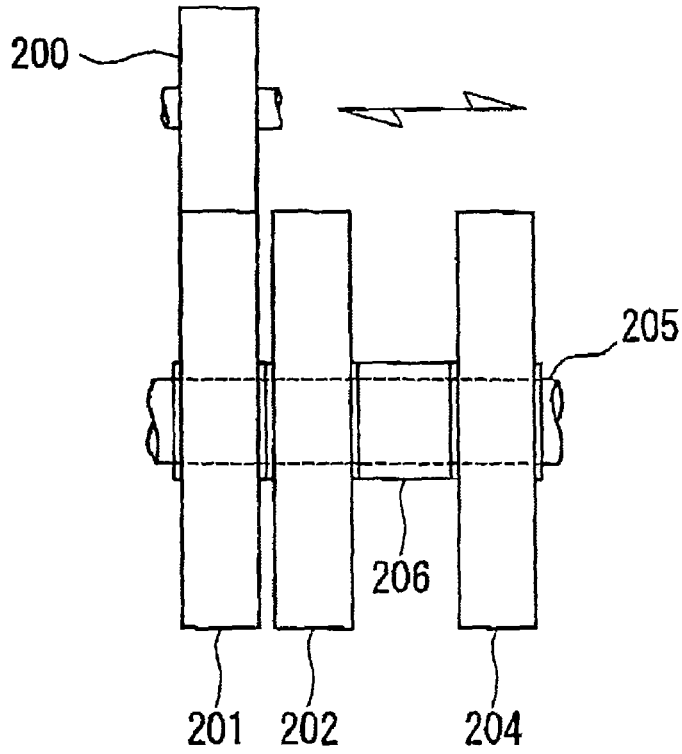

The complex machine 1*a* does not have the feeding tray 11. Therefore, the complex machine 1*a* is constructed without the feeding tray 11 of the complex machine 1 and the mechanism for sending a paper from the feeding tray 11. Therefore, the set of driven gears in the complex machine 1*a* is configured without the third driven gear 125 which appears in the set of driven gears for the complex machine 1. FIG. 26 shows the set of driven gears of the complex machine 1*a*. As shown in FIG. 26, the set of driven gears of the complex machine 1*a* have the driven gears 123, 124 and 126, but do not have the third driven gear 125. In these circumstances, an end surface of the cylinder 165*a* of the fourth driven gear 126 is in contact with a member which is not shown, the end surface 171 of the cylinder 166 of the fourth driven gear 126 is in contact with the end surface 170 of the cylinder 161 of the first driven gear 123, and an end surface of the cylinder 161*a* of the first driven gear 123 is in contact with a member which is not shown. Therefore, the first driven gear 123 and the fourth driven gear 126 can rotate without moving along the axial direction. Moreover, the second driven gear 124 is placed so that the cylinders 163, 172 are positioned between the contact surface 164 of the first driven gear 123 and the end surface 171 of the cylinder 166 of the fourth driven gear 126. Therefore, the second driven gear 124 can rotate without moving alone the axial direction.

As described above, in the complex machine 1*a*, even without the third driven gear 125, the positions of the driven gears 123, 124 and 126 in the axial direction are fixed. Therefore, the driven gears 123, 124 and 126 can rotate without moving along the axial direction. Specifically, it is not necessary to provide a spacer in the space generated by removing the third driven gear 125 (the space between the second driven gear 124 and the fourth driven gear 126).

The complex machine 1*b* does not have the feeding tray 11. Therefore, the complex machine 1*b* is constructed without the feeding tray 11 of the complex machine 1, the mechanism for sending a sheet of paper from the feeding tray 11, and the mechanism for transmitting driving force to the second feeding roller 89 for performing high-speed printing. Therefore, the set of driven gears in the complex machine 1*b* are configured without the driven gears 124 and 125 which appear in the set of driven gears for the complex machine 1. FIG. 26 shows the set of driven gears of the complex machine 1*b*. As shown in FIG. 26, the set of driven gears of the complex machine 1*b* has the driven gears 123 and 126, but does not have the driven gears 124 and 125. In these circumstances, the end surface of the cylinder 165*a* of the fourth driven gear 126 is in contact with a member which is not shown, the end surface 171 of the cylinder 166 of the fourth driven gear 126 is in contact with the end surface 170 of the cylinder 161 of the first driven gear 123, and the end surface of the cylinder 161*a* of the first driven gear 123 is in contact with a member which is not shown. Therefore, the first driven gear 123 and the fourth driven gear 126 can rotate without moving along the axial direction.

As described above, in the complex machine 1*b*, even without the driven gears 124 and 125, the positions of the driven gears 123 and 126 in the axial direction are fixed. Therefore, the driven gears 123 and 126 can rotate without moving along the axial direction. Specifically, it is not necessary to provide a spacer in a space generated by removing the driven gears 124 and 125 (a space between the first driven gear 123 and the fourth driven gear 126).

As described above, according to the set of driven gears of the complex machine 1 of the present embodiment, each of the driven gears 123 through 126 can rotate without moving along the axial direction.

Also, according to the set of driven gears of the complex machine 1, even without the third driven gear 125, the positional relationship among the first driven gear 123, the second driven gear 124 and the fourth driven gear 126 in the axial direction does not change. Therefore, when placing the set of driven gears in the complex machine 1*a* without providing the third driven gear 125, it is not necessary to provide a spacer in place of the third driven gear 125.

Moreover, according to the set of driven gears of the complex machine 1, even without the second driven gear 124 and the third driven gear 125, the positional relationship between the first driven gear 123 and the fourth driven gear 126 in the axial direction does not change. Therefore, when placing the set of driven gears in the complex machine 1*b* without providing the second driven gear 124 and third driven gear 125, it is not necessary to provide a spacer in place of the second driven gear 124 and third driven gear 125.

In the above-described complex machine 1, the fourth driven gear 126 transmits larger driving force, than the other driven gears. Since the cylinder 166 is formed on the fourth driven gear 126, the contact area between the fourth driven gear 126 and the shaft 122 is large. As a result of the larger contact area between the fourth driven gear 126 and the shaft 122, the fourth driven gear 126 can transmit larger driving force. It should be noted that, in the complex machine 1, the area of contact between the first driven gear 123 and the shaft 122 is also large. Therefore, a larger driving force may also be transmitted to the first driven gear 123.

The specific examples of the present invention are described in detail above, but these specific examples are merely examples and thus do not limit the scope of claims. The technologies of the present invention include the matters in which the above-described specific examples are modified and changed in various ways.

The technical elements described in the present specification and drawings achieve the technical utility independently or by combining these technical elements in various ways, and thus are not limited to the combinations which are described in the claims upon filing. Moreover, the technologies described in the present specification and drawings are to achieve a plurality of objects simultaneously and achieve the Technical utility by achieving one of the objects.

What is claimed is:

1. A printer, comprising:

a switch gear comprising a switch spur gear and being slidable along a direction that is parallel to a rotation axis of the switch spur gear;

a first driven gear comprising a first spur gear and a cylinder fixed to the first spur gear, the cylinder being concentric with respect to the first spur gear and extending along said direction, the first driven gear engaging with a first mechanism;

a second driven gear comprising a second spur gear with a hole that is concentric with respect to the second spur gear and extends along said direction, the second driven gear engaging with a second mechanism different from the first mechanism;

a sliding power source which generates a power for sliding the switch gear;

a slide mechanism configured to receive the power for sliding the switch gear generated by the sliding power source and to slide the switch gear along said direction; and a first tray for storing sheets, wherein the second driven gear is mounted on the first driven gear by inserting the cylinder of the first driven gear into the hole of the second driven gear and is rotatable with respect to the first driven gear around the cylinder, the slide mechanism slides the switch gear between a first position where teeth of the switch gear engage with teeth of the first spur gear and a second position where the teeth of the switch gear engage with teeth of the second spur gear along said direction, and the first mechanism is configured to feed the sheets from the first tray by receiving a first drive power transmitted via the first driven gear.

2. The printer as defined in claim 1, further comprising:

a third driven gear comprising a third spur gear with a hole that is concentric with respect to the third spur gear and extends along said direction, the third driven gear engaging with a third mechanism; and a fourth driven gear comprising a fourth spur gear and a cylinder fixed to the fourth spur gear, the cylinder of the fourth driven gear being concentric with respect to the fourth spur gear and extending along said direction, the fourth driven gear engaging with a fourth mechanism, wherein the third driven gear is mounted on the fourth driven gear by inserting the cylinder of the fourth driven gear into the hole of the third driven gear and rotatable with respect to the fourth driven gear around the cylinder of the fourth driven gear, a distal end of the cylinder of the first driven gear is in contact with a distal end of the cylinder of the fourth driven gear, and the slide mechanism slides the switch gear among positions comprising the first position, the second position, a third position where the teeth of the switch gear engage with teeth of the third spur gear, and a fourth position where the teeth of the switch gear engage with teeth of the fourth spur gear, along said direction.

3. The printer as defined in claim 1, wherein the first mechanism comprises gears and the second mechanism comprises gears, a part of the gears of the first mechanism can rotate independently from the gears of the second mechanism, and a part of the gears of the second mechanism can rotate independently from the gears of the first mechanism.

4. A printer, comprising:

a switch gear comprising a switch spur gear and being slidable along a direction that is parallel to a rotation axis of the switch spur gear;

a first driven gear comprising a first spur gear and a cylinder fixed to the first spur gear, the cylinder being concentric with respect to the first spur gear and extending along said direction, the first driven gear engaging with a first mechanism;

a second driven gear comprising a second spur gear with a hole that is concentric with respect to the second spur gear and extends along said direction, the second driven gear engaging with a second mechanism different from the first mechanism;

a third driven gear comprising a third spur gear with a hole that is concentric with respect to the third spur gear and extends along said direction, the third driven gear engaging with a third mechanism;

a fourth driven gear comprising a fourth spur gear and a cylinder fixed to the fourth spur gear, the cylinder of the fourth driven gear being concentric with respect to the fourth spur gear and extending along said direction, the fourth driven gear engaging with a fourth mechanism;

a sliding power source which generates a power for sliding the switch gear; and a slide mechanism configured to receive the power for sliding the switch gear generated by the sliding power source and to slide the switch gear along said direction, wherein the second driven gear is rotatably mounted on the first driven gear by inserting the cylinder of the first driven gear into the hole of the second driven gear, the third driven gear is rotatably mounted on the fourth driven gear by inserting the cylinder of the fourth driven gear into the hole of the third driven gear, a distal end of the cylinder of the first driven gear is in contact with a distal end of the cylinder of the fourth driven gear, a diameter of the cylinder of the first driven gear is smaller than a diameter of the cylinder of the fourth driven gear, the second driven gear is interposed between the first spur gear and the cylinder of the fourth driven gear, the third driven gear is interposed between the second driven gear and the fourth spur gear, and the slide mechanism slides the switch gear among positions comprising a first position where the switch gear engages with the first driven gear, a second position where the switch gear engages with the second driven gear, a third position where the switch gear engages with the third driven gear, and a fourth position where the switch gear engages with the fourth driven gear, along said direction.

5. A printer, comprising:

a switch gear comprising a switch spur gear and being slidable along a direction that is parallel to a rotation axis of the switch spur gear;

a first driven gear comprising a first spur gear and a cylinder fixed to the first spur gear, the cylinder being concentric with respect to the first spur gear and extending along said direction, the first driven gear engaging with a first mechanism;

a second driven gear comprising a second spur gear with a hole that is concentric with respect to the second spur gear and extends along said direction, the second driven gear engaging with a second mechanism different from the first mechanism;

a third driven gear comprising a third spur gear with a hole that is concentric with respect to the third spur gear and extends along said direction, the third driven gear engaging with a third mechanism;

a fourth driven gear comprising a fourth spur gear and a cylinder fixed to the fourth spur gear, the cylinder of the fourth driven gear being concentric with respect to the fourth spur gear and extending along said direction, the fourth driven gear engaging with a fourth mechanism;

a sliding power source which generates a power for sliding the switch gear;

a slide mechanism configured to receive the power for sliding the switch gear generated by the sliding power source and to slide the switch gear along said direction;

a first tray for storing sheets;

a second tray for storing sheets; and an inkjet head for discharging ink droplets, wherein the second driven gear is rotatably mounted on the first driven gear by inserting the cylinder of the first driven gear into the hole of the second driven gear, the third driven gear is rotatably mounted on the fourth driven gear by inserting the cylinder of the fourth driven gear into the hole of the third driven gear, a distal end of the cylinder of the first driven gear is in contact with a distal end of the cylinder of the fourth driven gear, the slide mechanism slides the switch gear among positions comprising a first position where the switch gear engages with the first driven gear, a second position where the switch gear engages with the second driven gear, a third position where the switch gear engages with the third driven gear, and a fourth position where the switch gear engages with the fourth driven gear, along said direction, and wherein:

the first mechanism is configured to intermittently feed the sheets from the first tray by receiving a first drive power transmitted via the first driven gear;

the second mechanism is configured to continuously feed the sheets from the first tray by receiving a second drive power transmitted via the second driven gear;

the third mechanism is configured to feed the sheets from the second tray by receiving a third drive power transmitted via the third driven gear; and the fourth mechanism is configured to execute maintaining the inkjet head by receiving a fourth drive power transmitted via the fourth driven gear.

6. A printer comprising:

a switch gear comprising a switch spur gear and being slidable along a direction that is parallel to a rotation axis of the switch spur gear;

a first driven gear comprising a first spur gear and a cylinder fixed to the first spur gear, the cylinder being concentric with respect to the first spur gear and extending along said direction, the first driven gear engaging with a first mechanism;

a second driven gear comprising a second spur gear with a hole that is concentric with respect to the second spur gear and extends along said direction, the second driven gear engaging with a second mechanism different from the first mechanism;

a sliding power source which generates a power for sliding the switch gear;

a slide mechanism configured to receive the power for sliding the switch gear generated by the sliding power source and to slide the switch gear along said direction; and an inkjet head for discharging ink droplets, wherein the second driven gear is mounted on the first driven gear by inserting the cylinder of the first driven gear into the hole of the second driven gear and is rotatable with respect to the first driven gear around the cylinder, the slide mechanism slides the switch gear between a first position where teeth of the switch gear engage with teeth of the first spur gear and a second position where the teeth of the switch gear engage with teeth of the second spur gear along said direction, and the slide mechanism comprises a carriage that mounts the inkjet head and reciprocates along said direction.

7. A set of driven gears commonly used for manufacturing a first type of printer comprising a first and a fourth mechanism, a second type of printer comprising the first, a second and the fourth mechanism, and a third type of printer comprising the first, the second, a third and the fourth mechanism, the set of driven gears comprising:

a first driven gear for engagement with the first mechanism;

a second driven gear for engagement with the second mechanism;

a third driven gear for engagement with the third mechanism; and a fourth driven gear for engagement with the fourth mechanism, wherein the first driven gear comprises a first spur gear and a cylinder fixed to the first spur gear, the cylinder of the first driven gear being concentric with respect to the first spur gear and extending along a direction that is parallel to a rotation axis of the first spur gear, the second driven gear comprises a second spur gear with a hole that is concentric with respect to the second spur gear and extends along a direction that is parallel to a rotation axis of the second spur gear, the third driven gear comprises a third spur gear with a hole that is concentric with respect to the third spur gear and extends along a direction that is parallel to a rotation axis of the third spur gear, the fourth driven gear comprises a fourth spur gear and a cylinder fixed to the fourth spur gear, the cylinder of the fourth driven gear being concentric with respect to the fourth spur gear and extending along a direction that is parallel to a rotation axis of the fourth spur gear, the first and fourth driven gears are used for manufacturing the first type of printer in a condition that a distal end of the cylinder of the first driven gear is in contact with a distal end of the cylinder of the fourth driven gear, the first, second and fourth driven gears are used for manufacturing the second type of printer in a condition that the distal end of the cylinder of the first driven gear is in contact with the distal end of the cylinder of the fourth driven gear, and the cylinder of the first driven gear is inserted into the hole of the second driven gear, and the first, second, third and fourth driven gears are used for manufacturing the third type of printer in condition that the distal end of the cylinder of the first driven gear is in contact with the distal end of the cylinder of the fourth driven gear, the cylinder of the first driven gear is inserted into the hole of the second driven gear, and the cylinder of the fourth driven gear is inserted into the hole of the third driven gear.

8. The set of driven gears as defined in claim 7, wherein the first, second and fourth driven gears are used for manufacturing the second type of printer in a condition that the second driven gear is rotatable with respect to the first driven gear around the cylinder of the first driven gear, and the first, second, third and fourth driven gears are used for manufacturing the third type of printer in a condition that the second driven gear is rotatable with respect to the first driven gear around the cylinder of the first driven gear, and the third driven gear is rotatable with respect to the fourth driven gear around the cylinder of the fourth driven gear.

9. A printer comprising:

a switch gear comprising a switch spur gear and being slidable along a direction that is parallel to a rotation axis of the switch spur gear;

a first driven gear comprising a first spur gear and a cylinder fixed to the first spur gear, the cylinder being concentric with respect to the first spur gear and extending along said direction, the first driven gear engaging with a first mechanism;

a second driven gear comprising a second spur gear with a hole that is concentric with respect to the second spur gear and extends along said direction, the second driven gear engaging with a second mechanism different from the first mechanism;

a sliding power source which generates a power for sliding the switch gear;

a slide mechanism configured to receive the power for sliding the switch gear generated by the sliding power source and to slide the switch gear along said direction; and an inkjet head for discharging ink droplets, wherein the second driven gear is mounted on the first driven gear by inserting the cylinder of the first driven gear into the hole of the second driven gear and is rotatable with respect to the first driven gear around the cylinder, the slide mechanism slides the switch gear between a first position where teeth of the switch gear engage with teeth of the first spur gear and a second position where the teeth of the switch gear engage with teeth of the second spur gear along said direction, and the first mechanism is configured to execute maintaining the inkjet head by receiving a first drive power transmitted via the first driven gear.

10. A printer comprising:

a switch gear comprising a switch spur gear and being slidable along a direction that is parallel to a rotation axis of the switch spur gear;

a first driven gear comprising a first spur gear and a cylinder fixed to the first spur gear, the cylinder being concentric with respect to the first spur gear and extending along said direction, the first driven gear engaging with a first mechanism;

a second driven gear comprising a second spur gear with a hole that is concentric with respect to the second spur gear and extends along said direction, the second driven gear engaging with a second mechanism different from the first mechanism;

a sliding power source which generates a power for sliding the switch gear;

a slide mechanism configured to receive the power for sliding the switch gear generated by the sliding power source and to slide the switch gear along said direction; and a roller, wherein the second driven gear is mounted on the first driven gear by inserting the cylinder of the first driven gear into the hole of the second driven gear and is rotatable with respect to the first driven gear around the cylinder, the slide mechanism slides the switch gear between a first position where teeth of the switch gear engage with teeth of the first spur gear and a second position where the teeth of the switch gear engage with teeth of the second spur gear along said direction, and the roller rotates to a first rotational direction when the switch gear rotates to a predetermined rotational direction at the first position, the roller rotates to a second rotational direction opposite to the first rotational direction when the switch gear rotates to the predetermined rotational direction at the second position.

* * * * *